US010557264B2

(12) United States Patent
Zavitz et al.

(10) Patent No.: US 10,557,264 B2
(45) Date of Patent: Feb. 11, 2020

(54) METHODS AND APPARATUSES FOR CONSTRUCTING A CONCRETE STRUCTURE

(71) Applicant: Tindall Corporation, Spartanburg, SC (US)

(72) Inventors: Bryant Zavitz, Dunwoody, GA (US); Kevin Kirkley, Dunwoody, GA (US)

(73) Assignee: Tindall Corporation, Spartanburg, SC (US)

( * ) Notice: Subject to any disclaimer, the term of this patent is extended or adjusted under 35 U.S.C. 154(b) by 0 days.

(21) Appl. No.: 16/031,871

(22) Filed: Jul. 10, 2018

(65) Prior Publication Data

US 2019/0010695 A1 Jan. 10, 2019

Related U.S. Application Data

(60) Provisional application No. 62/530,319, filed on Jul. 10, 2017.

(51) Int. Cl.

| | |
|---|---|
| ***E04C 2/52*** | (2006.01) |
| ***E04B 5/17*** | (2006.01) |
| ***E04B 5/43*** | (2006.01) |
| ***E04C 3/293*** | (2006.01) |
| ***E04C 5/06*** | (2006.01) |
| ***E04C 3/34*** | (2006.01) |
| *E04C 5/10* | (2006.01) |
| *E04B 5/38* | (2006.01) |

(52) U.S. Cl.

CPC ..... *E04B 5/17* (2013.01); *E04B 5/43* (2013.01); *E04C 3/293* (2013.01); *E04C 3/34* (2013.01); *E04C 5/0645* (2013.01); *E04B 5/38* (2013.01); *E04C 5/10* (2013.01)

(58) Field of Classification Search

CPC ..... E04B 5/17; E04B 5/43; E04B 5/38; E04C 3/34; E04C 3/293; E04C 5/0645; E04C 5/10

USPC ..... 52/220.1

See application file for complete search history.

(56) References Cited

U.S. PATENT DOCUMENTS

| | | | | | |
|---|---|---|---|---|---|
| 915,421 | A * | 3/1909 | Eisen | 52/236.9 | |
| 3,613,325 | A * | 10/1971 | Yee | E04B 1/20 | 52/236.8 |
| 3,918,222 | A * | 11/1975 | Bahramian | E04B 5/04 | 29/452 |
| 4,081,935 | A * | 4/1978 | Wise | E04B 1/21 | 52/236.8 |
| 4,505,087 | A * | 3/1985 | Sarda | E04B 5/43 | 264/31 |

(Continued)

OTHER PUBLICATIONS

International Search Report and Written Opinion issued for Application No. PCT/US2018/041493, dated Oct. 30, 2018.

*Primary Examiner* — Basil S Katcheves

(74) *Attorney, Agent, or Firm* — Meunier Carlin & Curfman LLC

(57) ABSTRACT

Various implementations comprise methods and apparatuses for constructing a concrete structure. An apparatus according to one implementation includes a structure comprising a pre-cast concrete component that includes at least one post-tensioning duct, a post-tensioning tendon extending through the post-tensioning duct, and a poured in place concrete surface disposed above and coupled to the pre-cast concrete component.

19 Claims, 25 Drawing Sheets

(56) References Cited

U.S. PATENT DOCUMENTS

| | | | | | |
|---|---|---|---|---|---|
| 5,161,340 | A * | 11/1992 | Wetton | E04B 1/21 | 52/236.7 |
| 5,390,464 | A * | 2/1995 | West | E04B 5/43 | 52/741.1 |
| 5,507,124 | A * | 4/1996 | Tadros | E04B 5/43 | 52/251 |
| 5,809,712 | A * | 9/1998 | Simanjuntak | E04C 5/08 | 52/223.7 |
| 8,800,229 | B2 | 8/2014 | Rahimzadeh et al. | | |
| 9,683,361 | B2 * | 6/2017 | Timberlake | E04C 5/0604 | |
| 10,094,101 | B1 * | 10/2018 | Jazzar | E04B 1/04 | |
| 10,106,973 | B1 * | 10/2018 | Sarda | E04B 1/21 | |
| 2016/0230386 | A1 * | 8/2016 | Zavitz | E04B 5/17 | |
| 2017/0159294 | A1 | 6/2017 | Sanabra Loewe | | |

* cited by examiner

SECTION A-A

SECTION B-B

SECTION A-A

SECTION B-B 1-1

2-2

8-8

SECTION "C-C"

SECTION "B-B"

DETAIL "B"

SECTION "A-A"

DETAIL "A"

DETAIL "E"

SECTION "F-F"

SECTION "G-G"

SECTION "E-E"

SECTION "H-H"

SECTION "J-J"

METHODS AND APPARATUSES FOR CONSTRUCTING A CONCRETE STRUCTURE

CROSS REFERENCE TO RELATED APPLICATIONS

This application claims the benefit of U.S. Provisional Patent Application No. 62/530,319, filed Jul. 10, 2017, the content of which is incorporated herein by reference in its entirety.

BACKGROUND

Natural gas is becoming a greater and greater share of the U.S. energy supply due to advances in hydraulic fracking. Natural gas is generally sent through a pipeline to a terminal, where it is compressed to liquefied natural gas (LNG) before loading it into tanks for transport. This terminal generally includes a platform to support four to seven compressors, each of which weighs several tons. Due to the increased supply of natural gas, additional terminals are needed to process the supply. However, the terminals are presently constructed by pouring concrete in place for all of the structure, which can take on the order of six months.

Thus, there is a need for more efficient apparatuses and methods of constructing a concrete structure.

SUMMARY

Various implementations include methods and apparatuses for constructing a concrete structure. For example, in various implementations, a structure includes a pre-cast concrete component having at least one post-tensioning duct, a post-tensioning tendon extending through the post-tensioning duct, and a poured in place concrete body disposed above and coupled to the pre-cast concrete component.

In some implementations, the structure has isotropic load-bearing strengths.

In some implementations, the pre-cast concrete component is a column. In some implementations, the pre-cast concrete component is a cap disposed on a top of a column.

In some implementations, the pre-cast concrete component is a floor section that is coupled to a cap disposed on top of a column. In some implementations, the poured in place concrete body is directly coupled to a floor section by one or more reinforcement members that extend through at least a portion of the floor section and into the poured in place concrete body. In some implementations, the floor section has a perimeter, and the cap has a support member that includes an alignment projection that extends upwardly from a portion of an upper surface of the support member. The alignment projection has an outer perimeter, and the upper surface of the support member has an outer perimeter. The outer perimeter of the upper surface of the support member is spaced apart from the outer perimeter of the alignment projection, and a portion of a lower surface of the floor section adjacent the perimeter of the floor section abuts the upper surface of the support member of the cap such that the alignment projection of the cap extends upwardly along a portion of the perimeter of the floor section. In some implementations, the poured in place concrete body comprises a first stage composite pour and a second stage composite pour. The first stage composite pour is coupled to a portion of the perimeter of the floor section, the outer perimeter of the alignment projection, and a portion of the upper surface of the support member. The second stage composite pour is coupled to the first stage composite pour and an upper surface of the floor section.

In some implementations, the floor section includes the plurality of reinforcement members extending from the upper surface of the floor section, and the plurality of reinforcement members are coupled to the second stage composite pour.

In some implementations, the poured in place concrete body is directly coupled to the pre-cast component by one or more reinforcement members that extend through at least a portion of the pre-cast component and into the poured in place concrete body.

In some implementations, the pre-cast concrete component is a floor section.

In some implementations, the poured in place concrete body defines one or more apertures that extend through the concrete body.

Other various implementations include a method for making a structure including: (1) providing a plurality of pre-cast concrete columns, (2) placing a pre-cast concrete column cap on each of the columns, (3) placing a floor section with a post-tensioning duct on a support member of each column cap, (4) tensioning a post-tensioning tendon running through a post-tensioning duct, and (5) pouring a poured in place concrete body on the floor sections. At least one of the floor sections comprises the post-tensioning duct.

In some implementations, the poured in place concrete body defines a plurality of apertures that extend through the concrete body.

In some implementations, the floor sections are pre-cast concrete floor sections.

In some implementations, at least one column cap includes a post-tensioning duct, and the method further includes tensioning a second post-tensioning tendon running through the post-tensioning duct in the column cap.

In some implementations, the post-tensioning tendon and the second post-tensioning tendon are arranged perpendicularly to each other as viewed from an upper surface of the floor section and column cap.

In various implementations, a structure includes a pre-cast concrete column, a pre-cast concrete cap disposed above a top surface of the column, the pre-cast concrete cap including at least one post-tensioning duct, a pre-cast concrete floor section that is disposed above the pre-cast concrete cap, a post-tensioning tendon extending through the post-tensioning duct, and a poured in place concrete body disposed on the floor section. In some implementations, the poured in place concrete body defines one or more apertures that extend through the concrete body. In some implementations, the cap is disposed on the top surface of the column, and the floor section is disposed on the cap.

BRIEF DESCRIPTION OF THE DRAWINGS

Example features and implementation are disclosed in the accompanying drawings. However, the present disclosure is not limited to the arrangements and instrumentalities shown. Furthermore, various features may not be drawn to scale.

DETAILED DESCRIPTION

Figure 6:
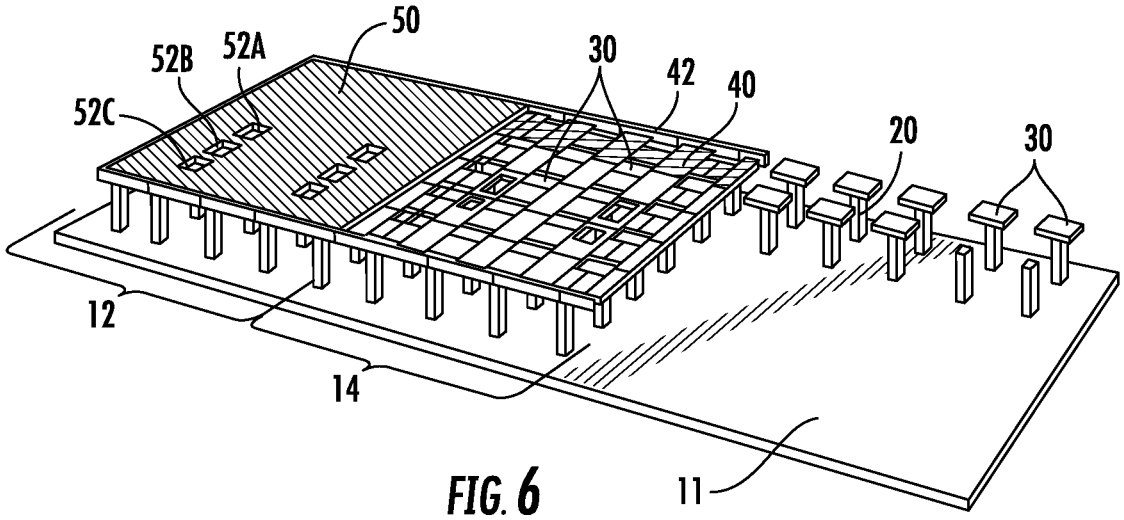
Figure 7:
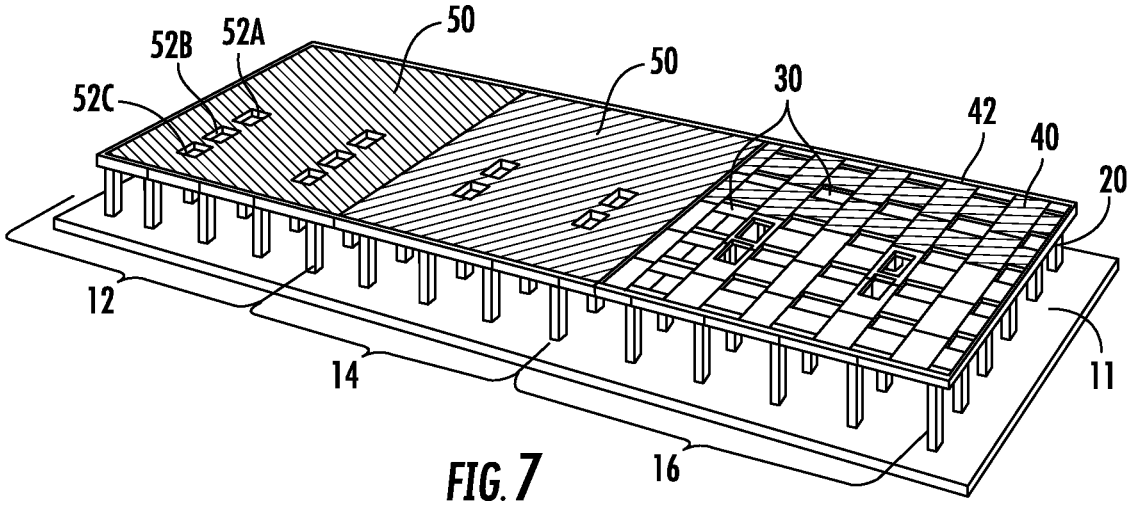
Figure 8:
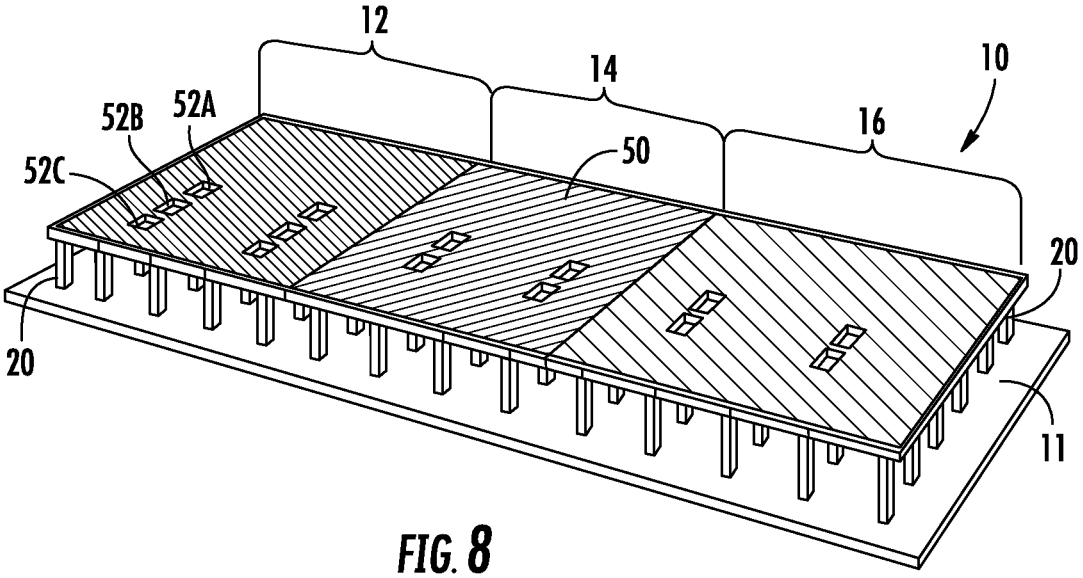

FIGS. 1-8 show example process steps for constructing a structure 10 according to one implementation, and FIGS. 9-27 illustrate details of each component and how the components are coupled together according to various implementations. FIG. 8 shows the final structure 10 according to one implementation. Structure 10 includes columns 20 to support a main body 50. For example, the main body 50 supports one or more compressors used to compress the LNG, according to some implementations. Main body 50 defines one or more apertures 52A, 52B, and 52C. These apertures allow pipes (not shown) to access the compressors from below the main body 50. These pipes may link the compressors to each other, as the compression is done in stages. The pipes may also connect to storage tanks to pull off components of the natural gas that liquefy during a particular compression stage.

In the implementation shown in FIG. 8, there are six stages to the LNG compression process. Thus, there are six sets of apertures 52A, 52B, and 52C (e.g., each set having two or more apertures). The compression process compresses the natural gas from approximately 5-20 psi to approximately 1,700 psi. Natural gas is mostly methane, but does include other hydrocarbons. Thus, there are other components of the natural gas that liquefy before the methane does. Accordingly, some of the compressors are designed to pull off these other components as the natural gas is compressed. For example, in the implementation shown in FIG. 8, the two left-most compressors on the first section 12 of the main body 50 need three apertures to provide the piping necessary for their compression stage, while the other four compressors to be disposed on the second section 14 and the third section 16 only need two apertures. However, other implementations may include any number of stages and access apertures.

Figure 1:
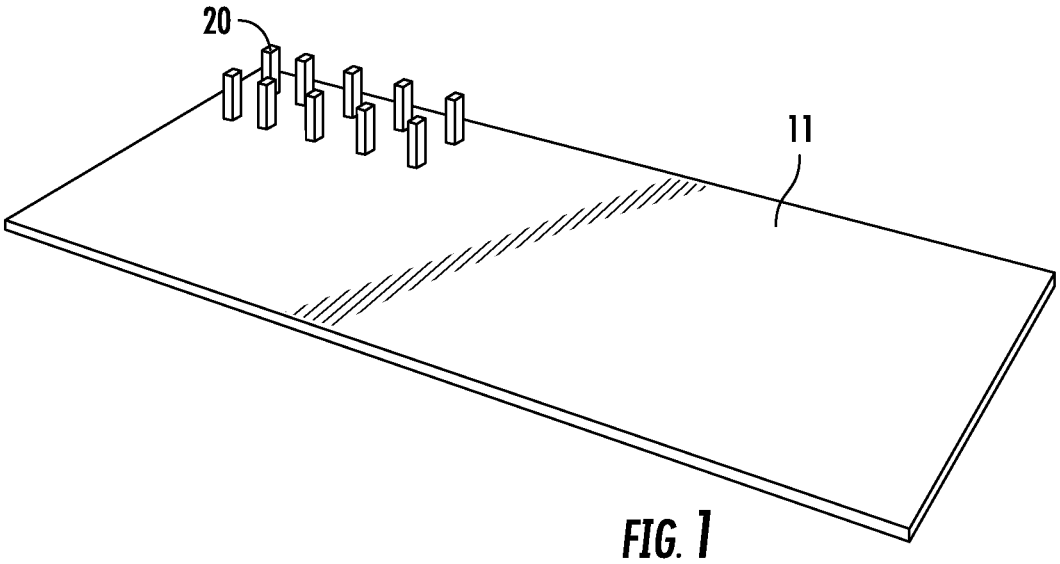
FIGS. 1-8 illustrate a process for making a concrete structure according to one implementation.
Figure 27:
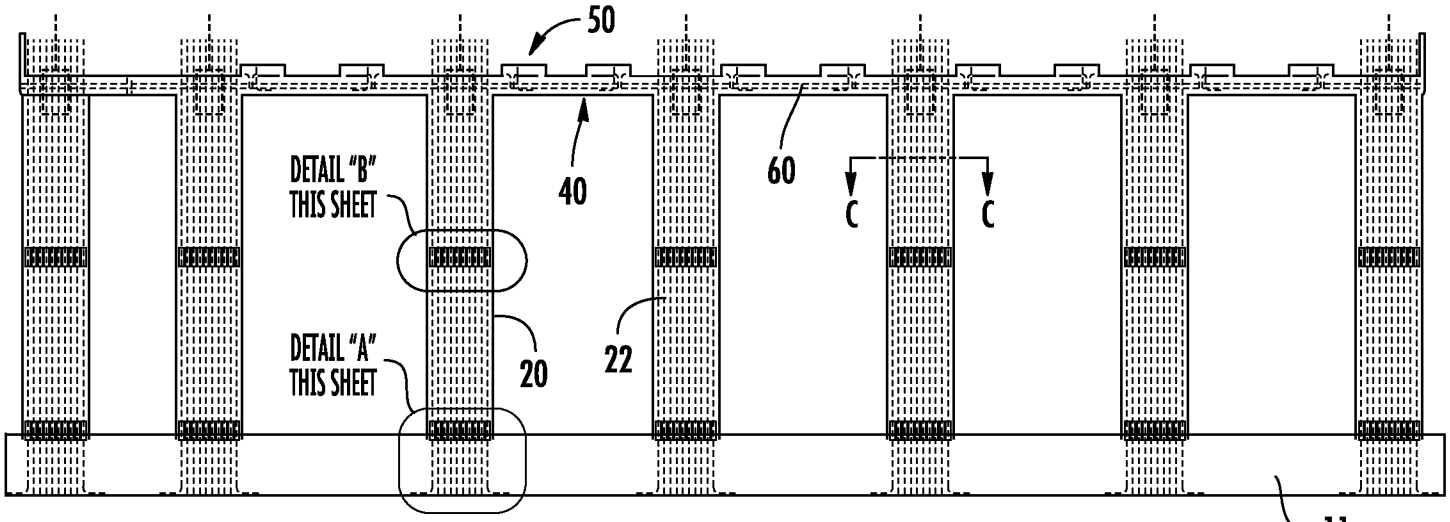
FIG. 27 illustrates a side view of a portion of the concrete structure according to the implementation shown in FIG. 26.
Figure 28E:
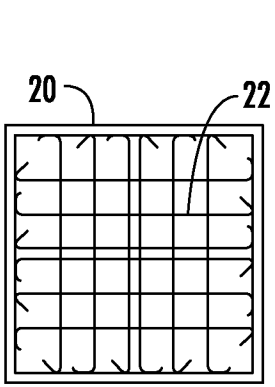
FIGS. 28A-E illustrate cross-sectional and detail views of portions of the concrete structure according to the implementation shown in FIGS. 26 and 27.
Figure 28D:
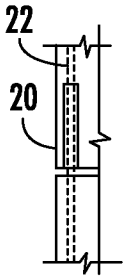
Figure 28C:
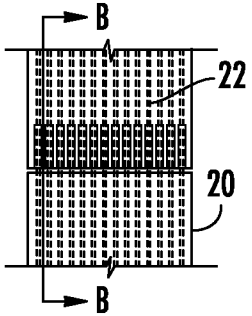
Figure 28B:
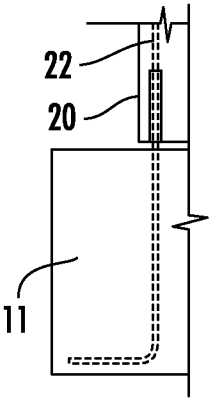
Figure 28A:
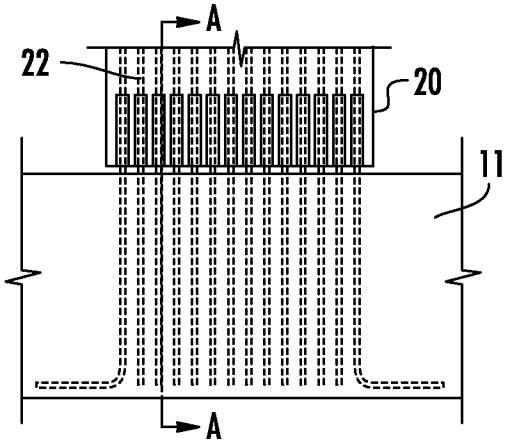
Figure 29B:
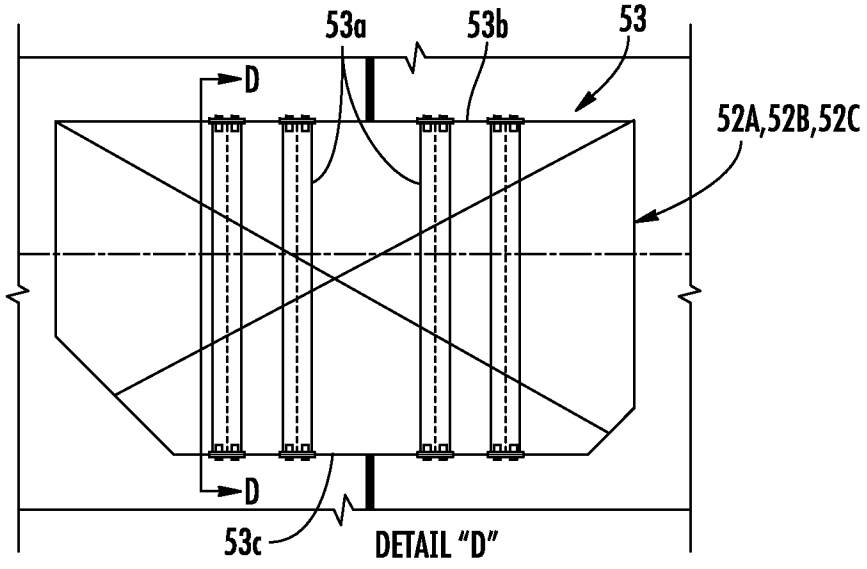
FIGS. 29A-C illustrate cross-sectional and detail views of portions of the concrete structure according to the implementation shown in FIGS. 26 and 27.
Figure 29A:
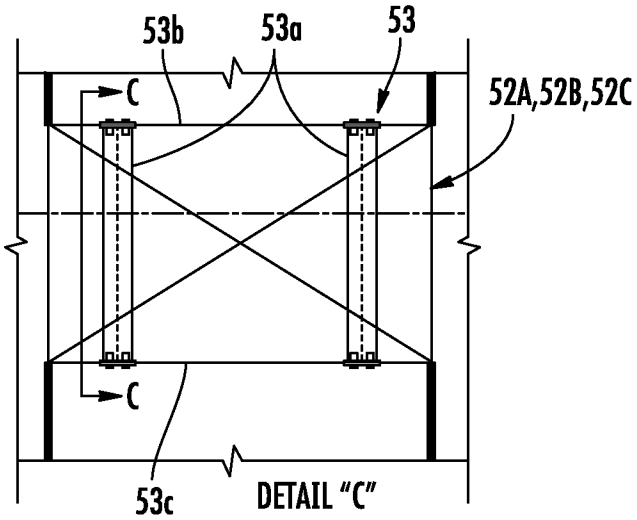
Figure 29C:
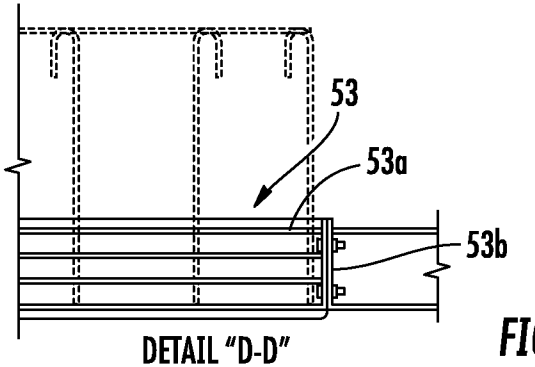
Figure 30A:
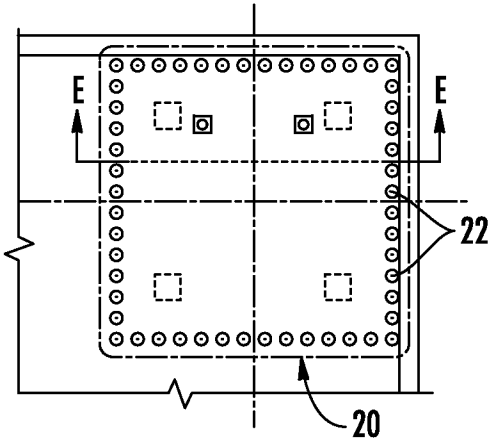
FIGS. 30A-F illustrate cross-sectional and detail views of portions of the concrete structure according to the implementation shown in FIGS. 26 and 27.
Figure 30B:
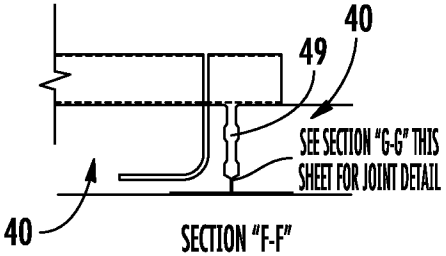
Figure 30C:
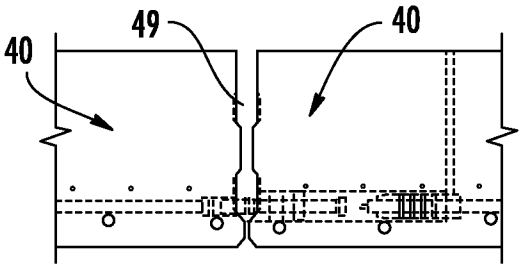
Figure 30D:
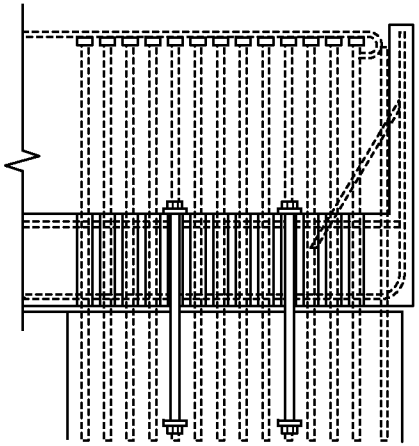
Figure 30E:
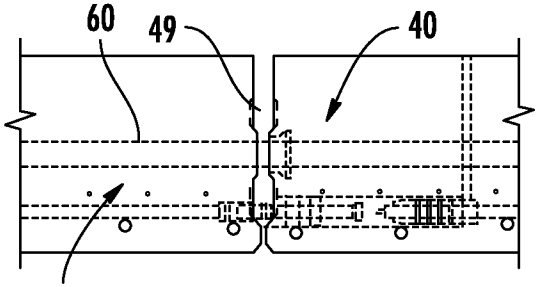
Figure 30F:
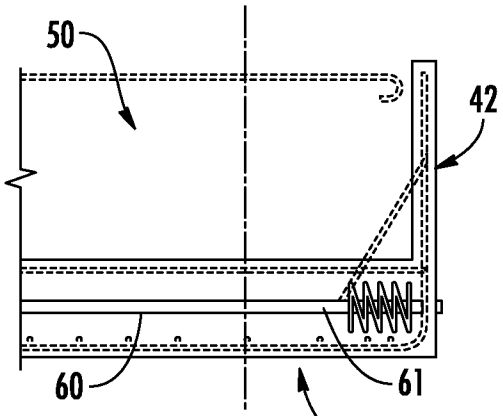

FIG. 1 shows that the first step includes placing columns 20. The columns 20 in FIGS. 1-9 are shown as having a rectangular cross-sectional shape, but in other implementations, the columns can have any suitable cross sectional shape (e.g., circular, ovular, hexagonal, or other suitable closed shape). In addition, the columns 20 are coupled to the foundation 11 (e.g., as shown in FIGS. 1-8 and 27-28B), to another vertically adjacent column 20 (e.g., as shown in FIGS. 28C-28D), or directly to the ground (not shown). The columns 20 coupled to the foundation 11 (or ground) are horizontally spaced apart from each other in an array. In FIG. 1, the columns 20 are aligned in adjacent rows and columns. However, in other implementations, the columns in one row may be offset from the columns in adjacent rows. Example columns 20 are shown in FIGS. 9-11, 13-16, 18-23, and 25 and are described below.

Figure 2:
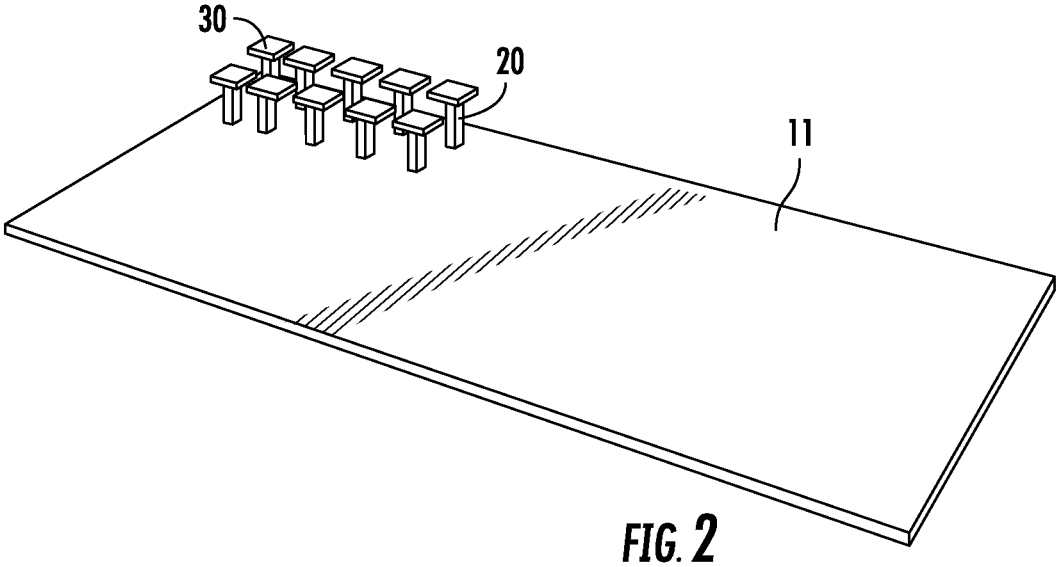
Figure 9:
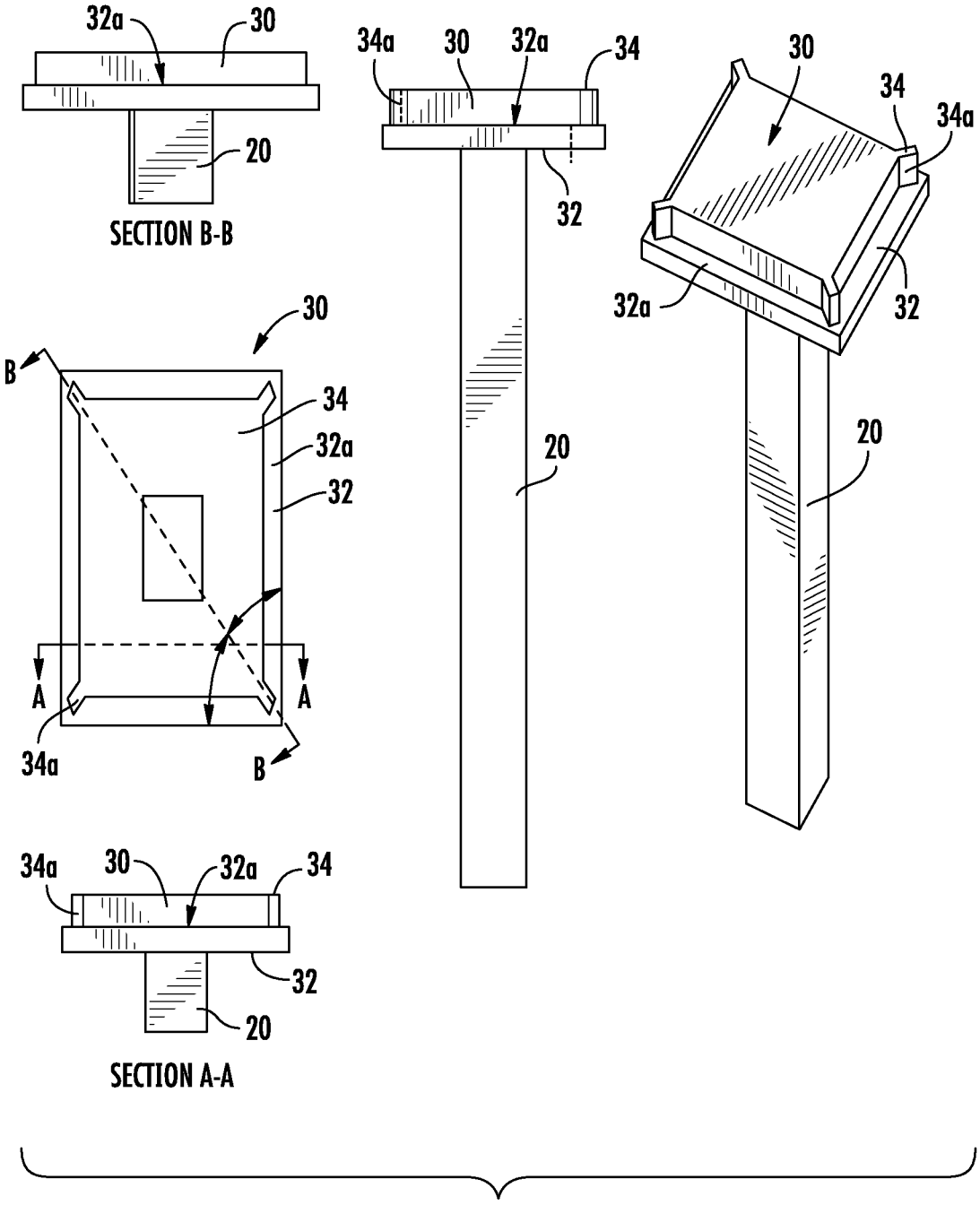
FIG. 9 illustrates several views of a column and a column cap according to the implementation shown in FIGS. 2-8.
Figure 10:
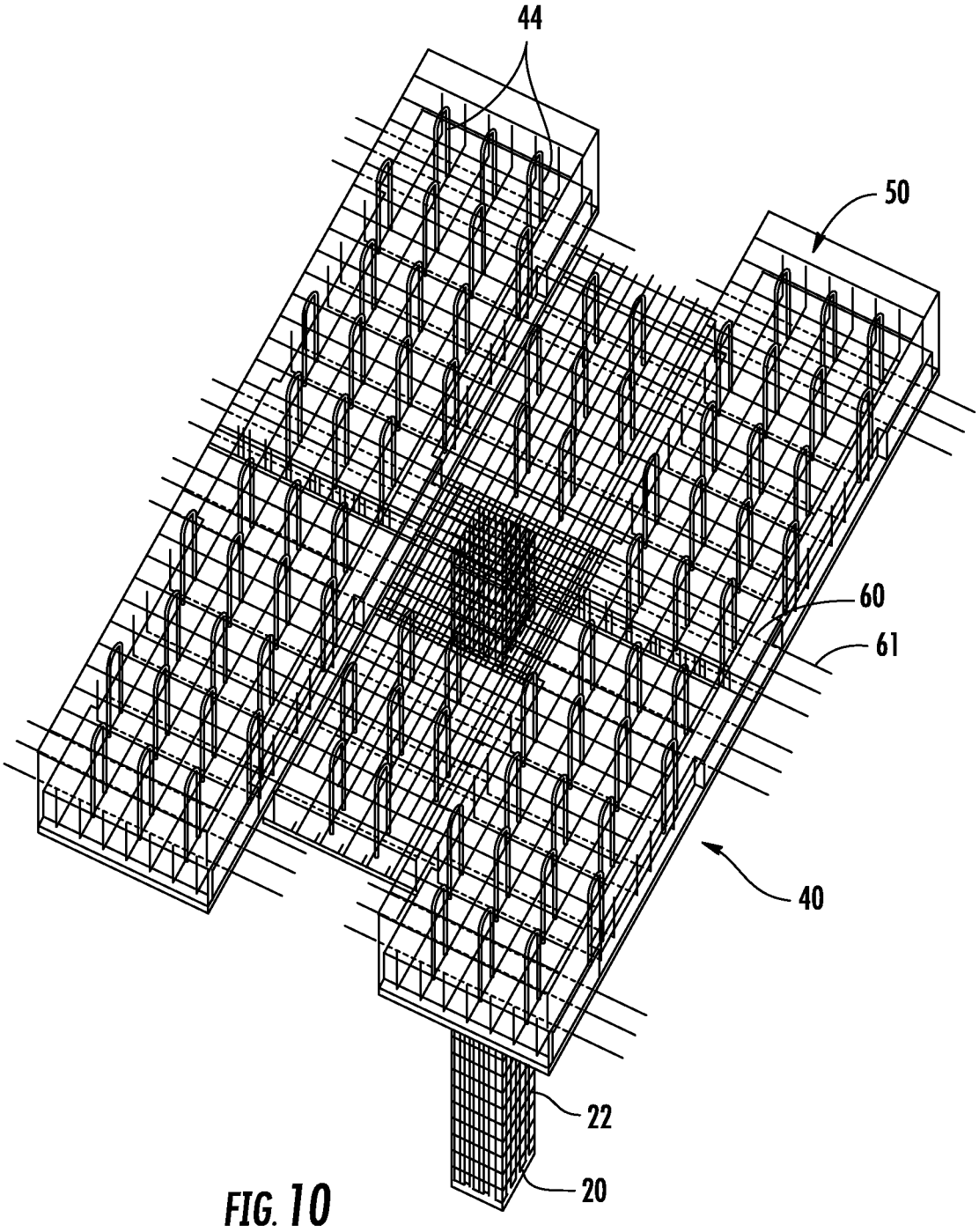
FIGS. 10 and 11 illustrate perspective views of the column cap with floor sections stacked thereon according to the implementation shown in FIGS. 3-8.

Column caps 30 are then placed on the columns as shown in FIG. 2. The column caps 30 in FIGS. 1-9 are shown as having a rectangular cross sectional shape, but in other implementations, the column caps can also have any suitable cross sectional shape (e.g., circular, ovular, hexagonal, or other suitable closed shape). FIG. 9 shows a column 20 and column cap 30 in greater detail. FIGS. 11-20 and 23-24 also show details of the column cap 30, which are described below.

Figure 3:
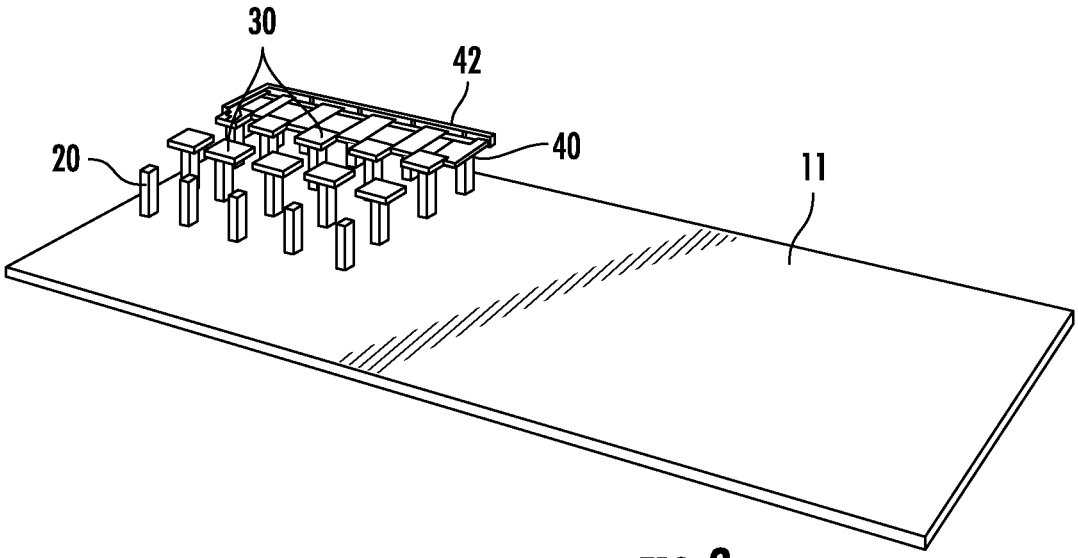
Figure 20:
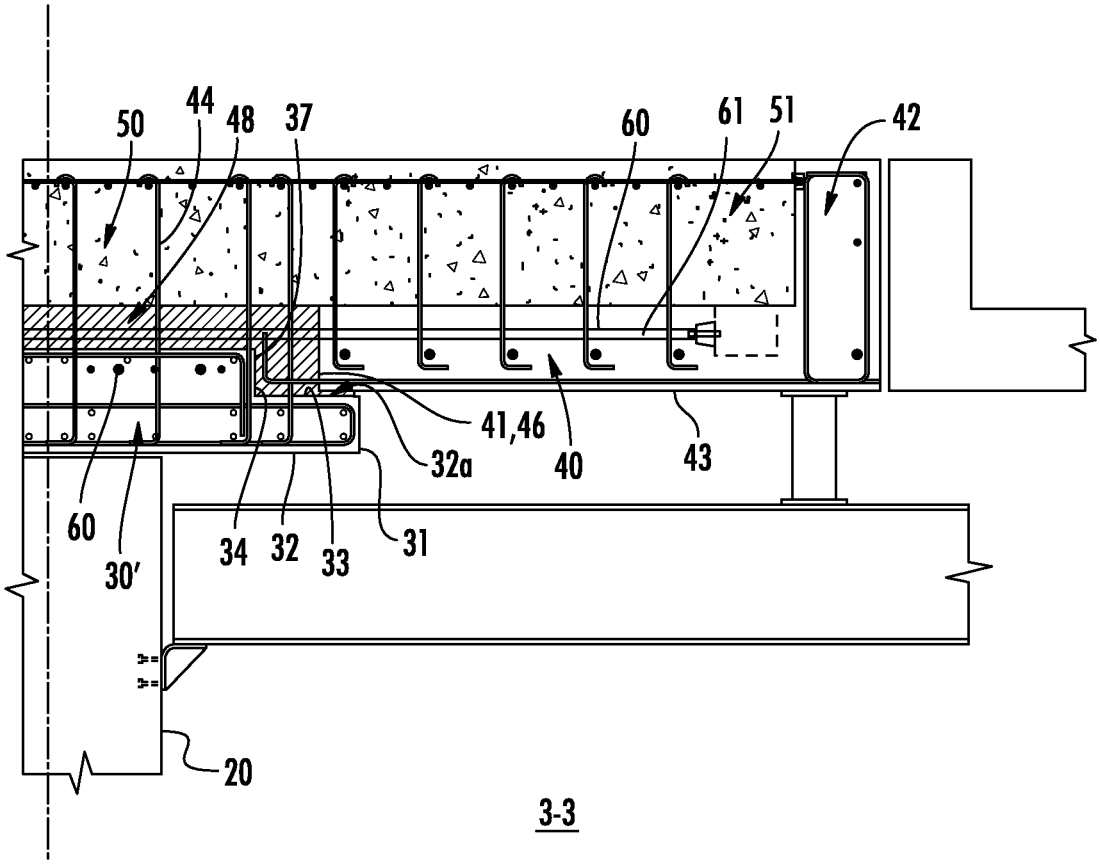
FIG. 20 illustrates a cross-sectional view of a portion of the concrete structure according to the implementation shown in FIG. 17 as viewed from the 3-3 line.
Figure 21:
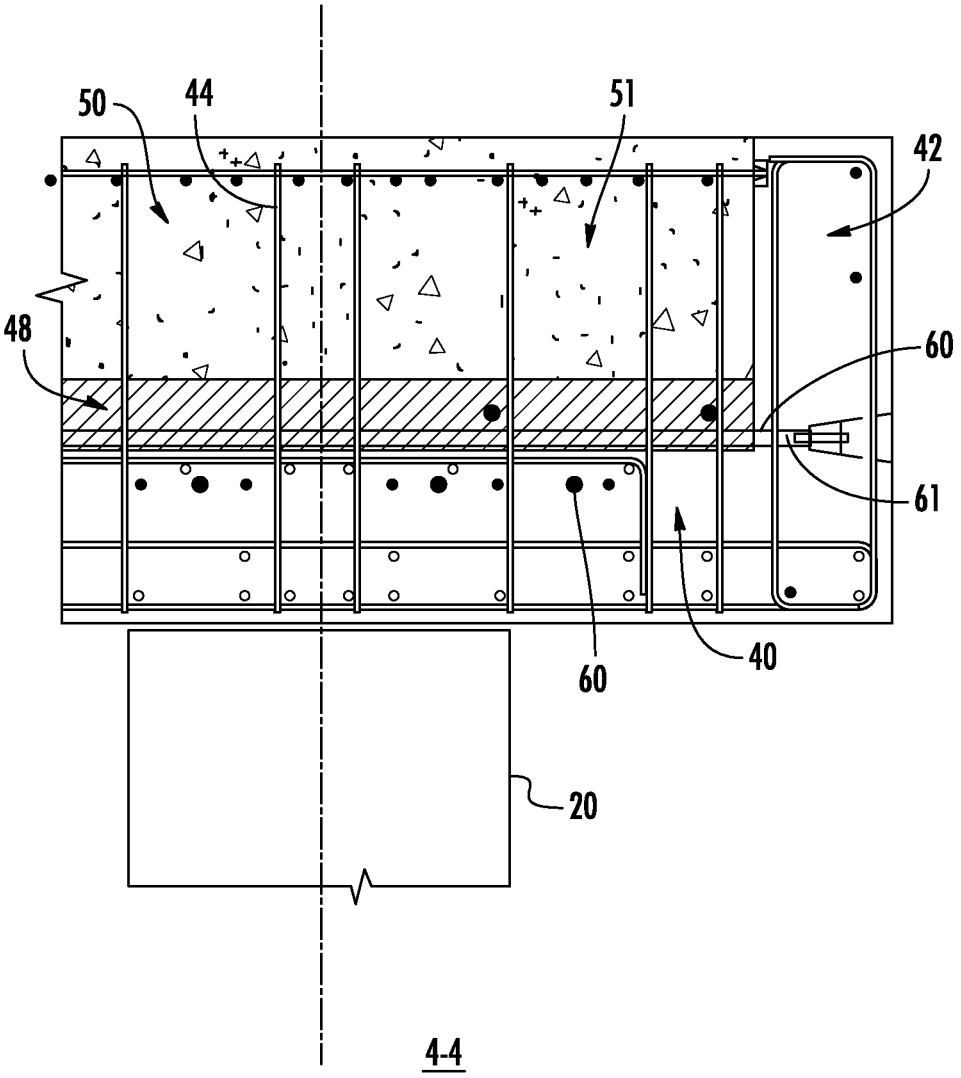
FIG. 21 illustrates a cross-sectional view of the concrete structure according to the implementation shown in FIG. 17 as viewed from the 4-4 line.
Figure 22:
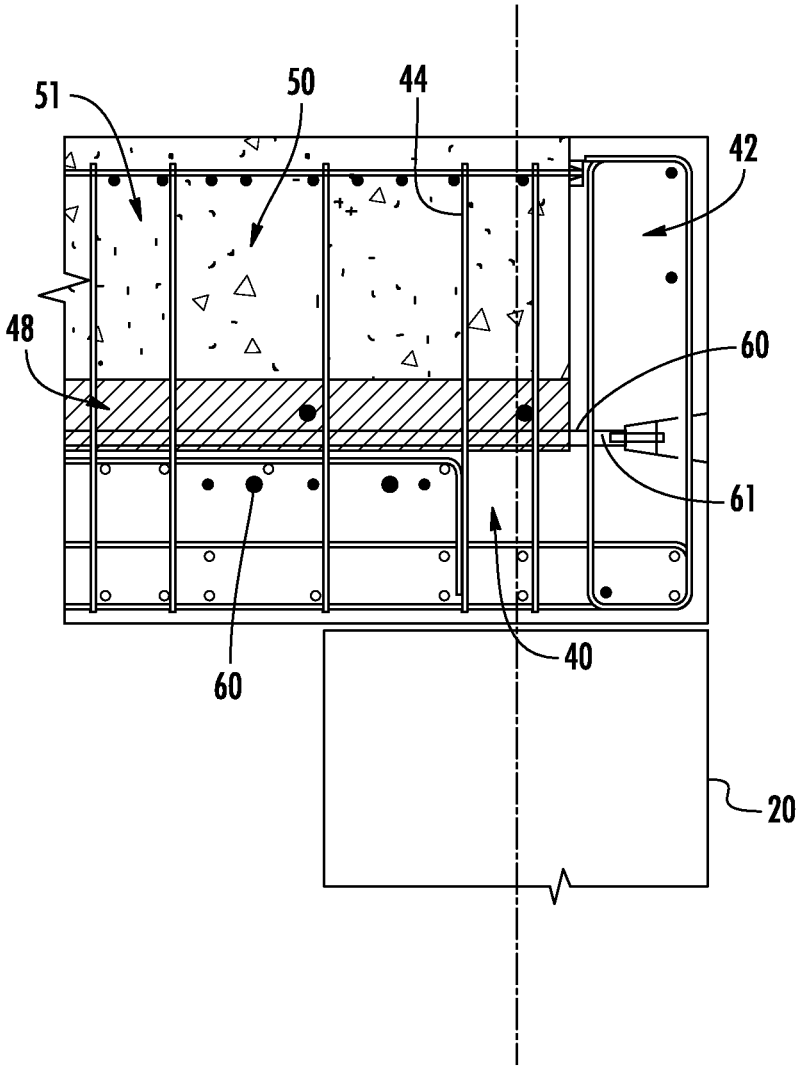
FIG. 22 illustrates a cross-sectional view of the concrete structure according to the implementation shown in FIG. 17 as viewed from the 5-5 line.
Figure 23:
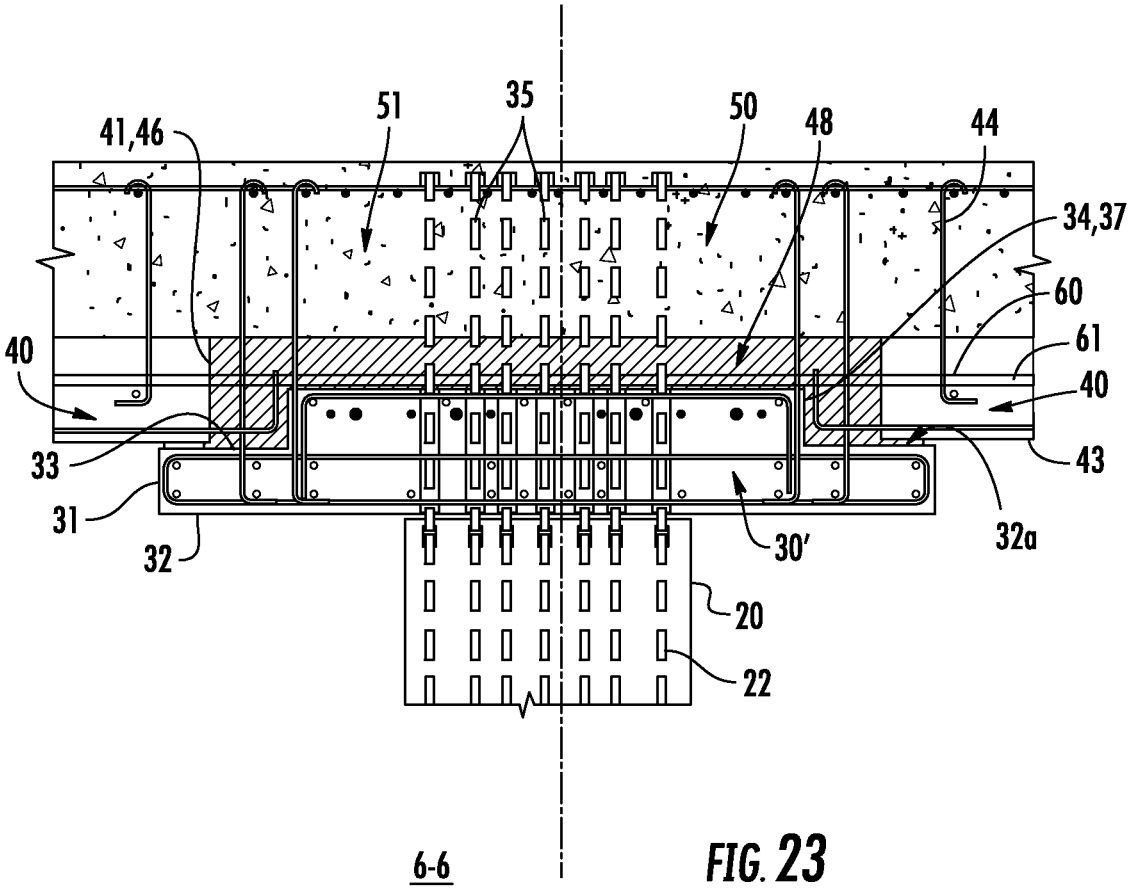
FIG. 23 illustrates a cross-sectional view of a portion of the concrete structure with vertical rods according to the implementation shown in FIG. 17 as viewed from the 6-6 line.

FIG. 3 shows side sections 42 and floor sections 40 placed on the column caps 20. The side sections 42 are disposed adjacent at least one perimeter edge of the floor section 40 as shown in FIGS. 20-22. FIGS. 9-24, 27, and 30B-30F show details of the floor sections 40 and side sections 42, which are described below.

Figure 4:
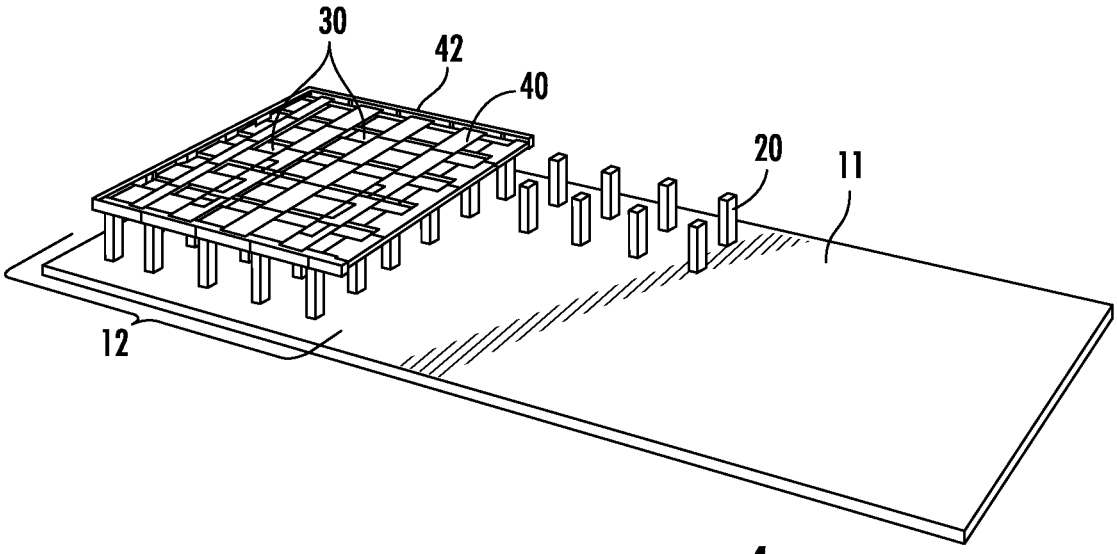
Figure 5:
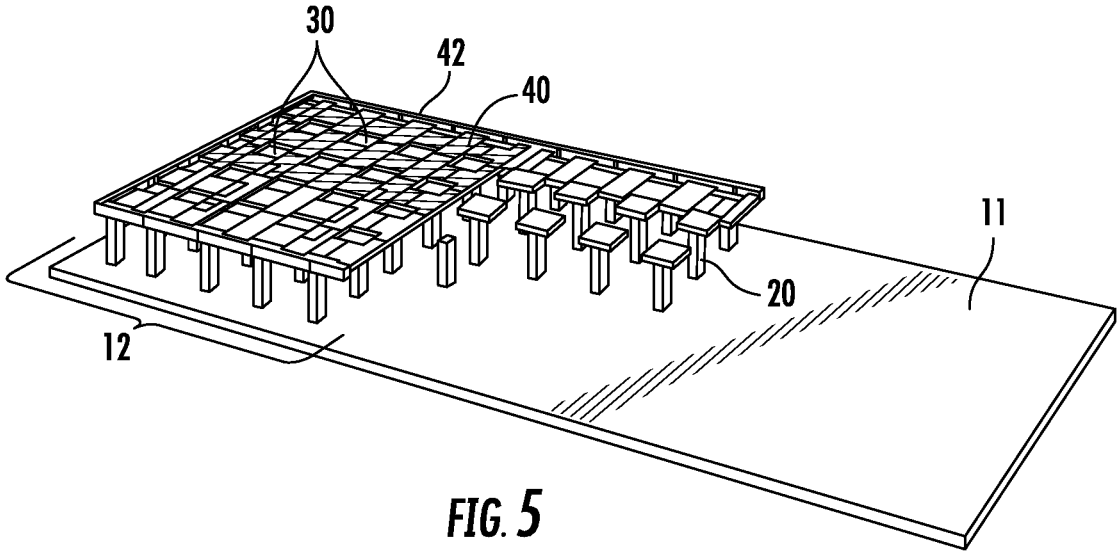

FIG. 4 shows the side sections 42 and floor sections 40 assembled for the first third 12 of the structure 10. The floor sections 40 define two or more apertures, such as apertures 52A, 52B, and 52C. As shown in FIG. 5, concrete is then poured to create the main body 50 for the first third 12 of the structure 10. These pours may be done incrementally, for example breaking each third of the structure into five pours each, as shown in FIGS. 5 and 7. FIGS. 6 and 7 show the middle 14 and final third 16 of the structure 10 being constructed in a similar manner as the first third 12. Finally, FIG. 8 shows the completed structure 10.

Because the column, column cap, floor section, and side section are pre-cast components, construction can be completed much faster than a structure made of poured in place concrete. The method described above in relation to FIGS. 1-8 minimizes the use of poured in place concrete, allowing dramatic time savings over current construction techniques.

FIGS. 9-16 show additional details of the pre-cast components 20, 30, 40 and 42. Columns 20 include steel reinforcement members 22 that extend between the foundation 11 and the column 20 and/or stacked columns 20, as shown in FIGS. 27-28E.

Figure 13:
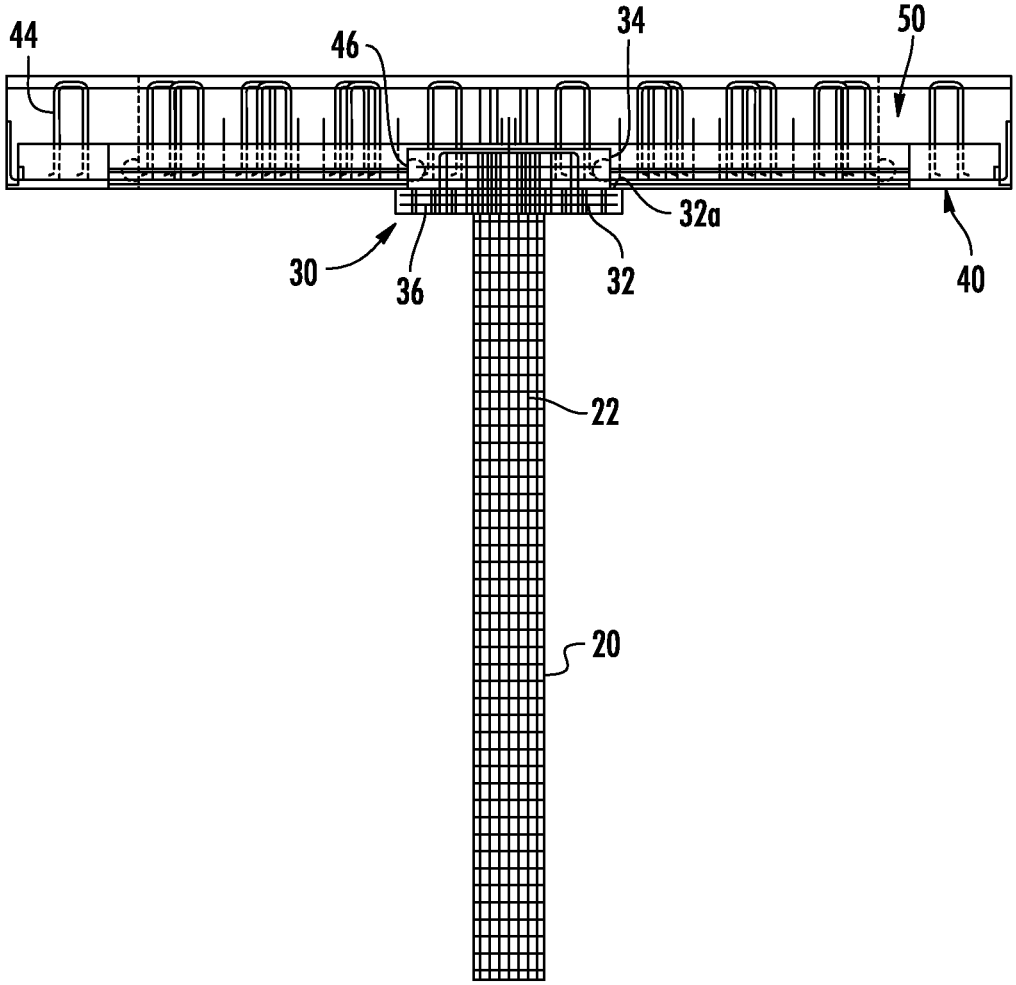
FIGS. 13 and 14 show side views of the floor sections supported by the column cap according to the implementation shown in FIGS. 3-8.
Figure 14:
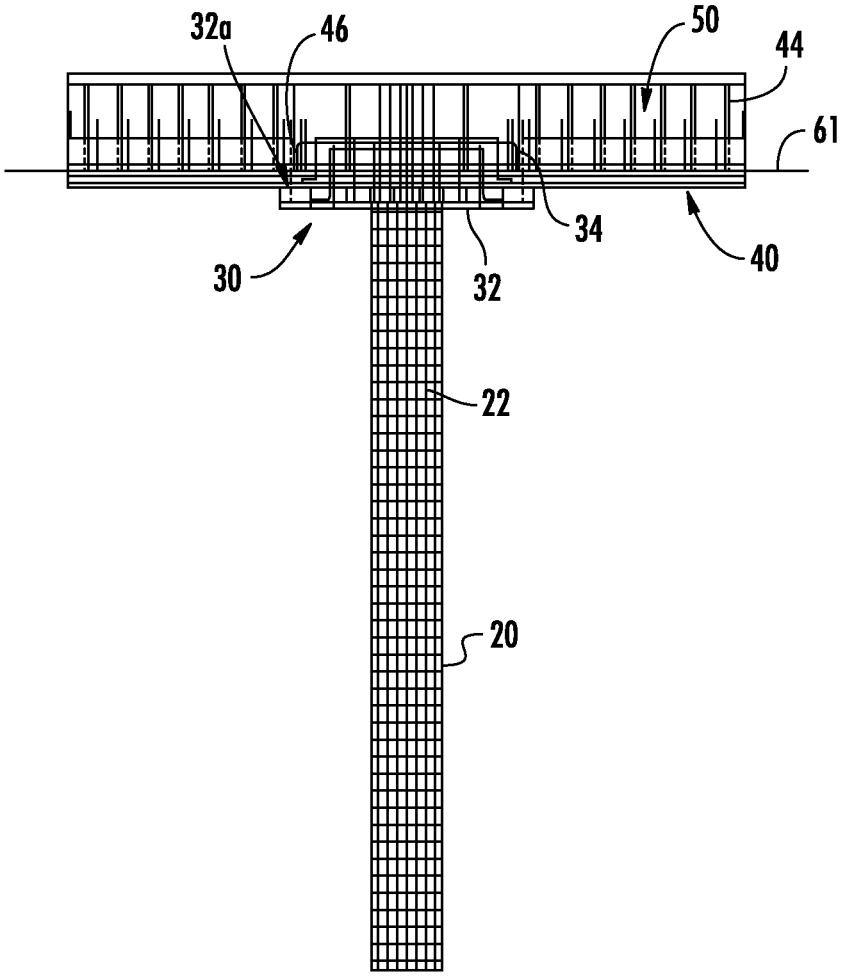

Column caps 30 include steel reinforcement members 36, which are shown in FIG. 13. As shown in FIG. 9, each column cap 30 also includes a support member 32 and an alignment projection 34. The alignment projection 34 extends upwardly from a portion of an upper surface 33 of the support member 32. The alignment projection 34 has an outer perimeter 37 that is spaced inwardly from an outer perimeter 31 of the upper surface 33 of the support member 32. In addition, alignment projection 34 has four corner protrusions 34*a* that extend horizontally and in a diagonal direction from each corner of the projection 34.

Figure 15:
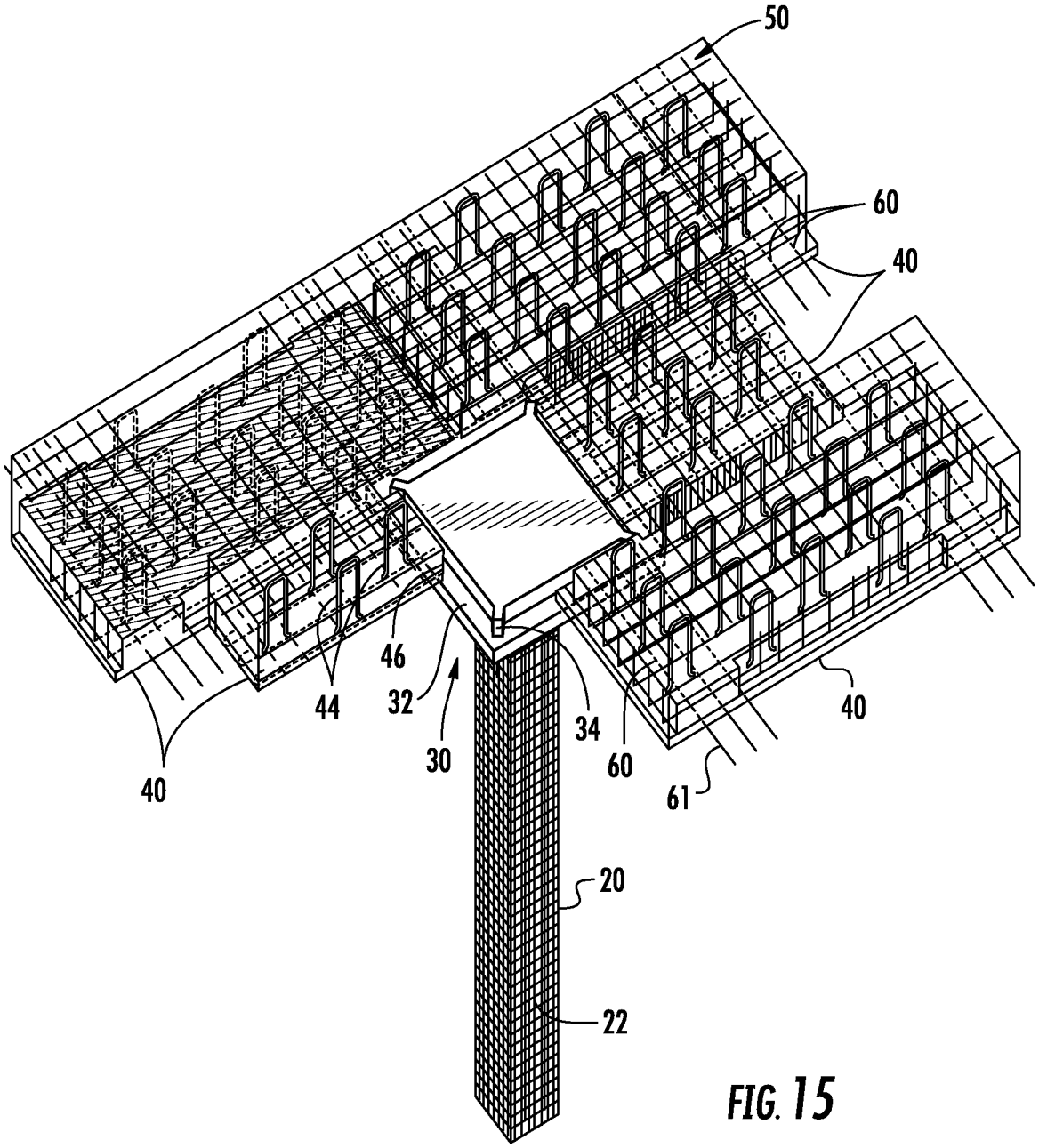
FIG. 15 shows a perspective cutaway view of the floor sections supported by the column cap according to the implementation shown in FIGS. 3-8.
Figure 16:
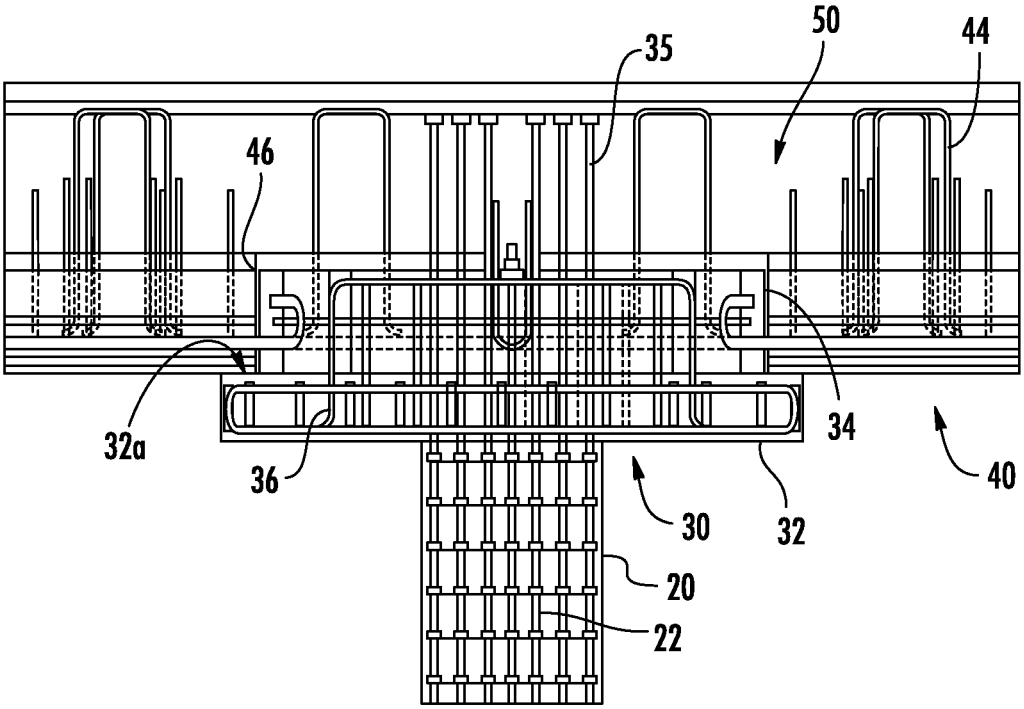
FIG. 16 shows close up side section views of the floor sections supported by the column cap according to the implementation shown in FIGS. 3-8.
Figure 16:
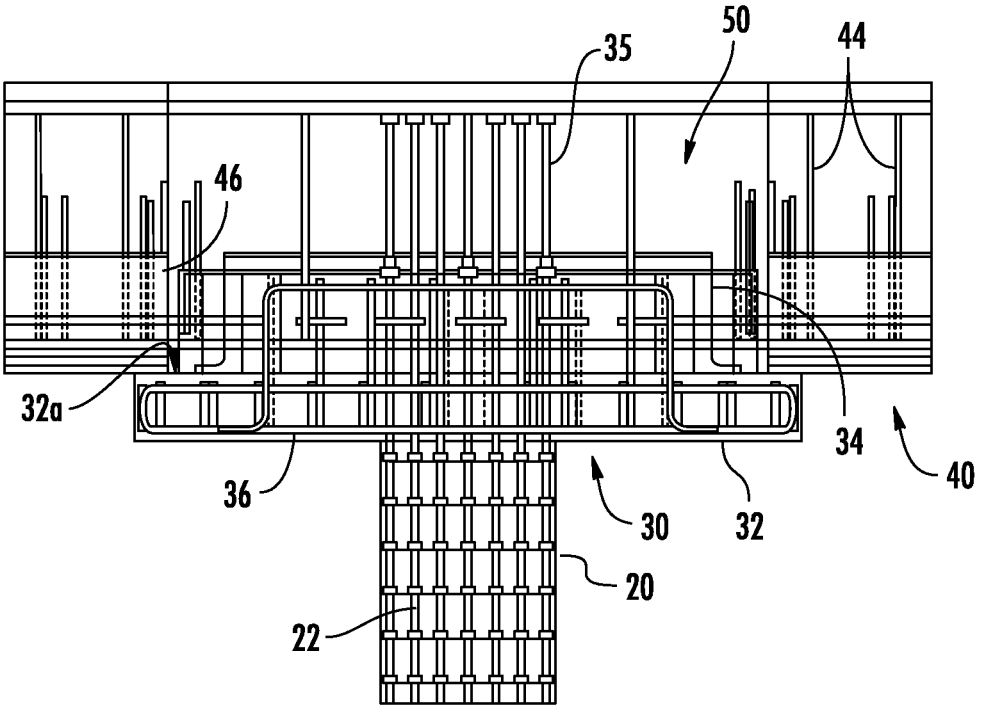

As shown in FIGS. 1-16, the floor sections 40 are continuous pre-cast concrete slabs. When assembled, at least two opposite and spaced apart edges of the lower surface 43 of the floor section 40 abut respective support portions 32*a* of the support members 32 of adjacent column caps 30. The respective support portion 32*a* is defined between the outer perimeter 37 of the alignment projection 34 and the outer perimeter 31 of the upper surface 33 of the respective support member 32. The outer perimeters 37 of the alignment projections 34 are adjacent to the perimeter 41 of the floor section 40. The alignment projections 34 lock the floor sections 40 into place (e.g., prevent horizontal shifting of the floor sections 40) between two or more column caps 30 prior to pouring the main body 50 and provide rigid support (e.g., more thickness as measured in a vertical direction) to the support members 32. The rigid support provided by the alignment projections 34 allows for thinner support members 32, which provides more clearance for pipes and equipment below the column caps 30. The diagonal shape of the corner projections 34*a* extending from the alignment projections 34 provide additional rigid support to the corners of the support members 32 and are less likely to interfere with any reinforcements protruding from adjacent floor sections 40. FIG. 15 shows a perspective view of a single column cap 30 with multiple floor sections 40 supported by support member 32 and aligned by alignment projection 34, and FIG. 16 shows a side cross sectional view of two of the floor sections 40 being supported by support member 32.

In other implementations (not shown), each floor section defines a central opening having a perimeter, and the perimeter of the central opening is greater than the outer perimeter 37 of the alignment projection 34 but less than the outer perimeter 31 of the upper surface 33 of the support member 32. When assembled, the portion of the support member 32 between the outer perimeter 37 of the alignment projection 34 and the outer perimeter 31 of the upper surface 33 of the support member 32 abuts a portion of the lower surface of the floor section that is stacked onto the upper surface 33 of the support member 32 of the column cap 30, and the alignment projection 34 of the column cap 30 extends into the central opening. In this implementation, the alignment projections 34 serve the purpose of locking the floor sections into place on the column caps 30 prior to pouring the main body 50. As in the previous implementation, the alignment projections 34 provide rigid support to the support members 32, which allows for thinner support members 32 and more clearance for pipes and equipment below the column caps 30.

FIGS. 1-20 and 23 show column 20 with lower surfaces 43 of each floor section 40 abutting column caps 30 or 30'. However, where a column 20 is supporting an edge of a floor section 40 along the outer edge of the structure 10, no column cap 30 or 30' is used. Where no column cap 30 or 30' is used, the column 20 is taller than the columns 20 with column caps and the lower surface 43 of the floor section 40 directly abuts the column 20 instead of a cap 30 or 30', as shown in FIGS. 21 and 22. In other implementations, the columns along the outer edges of the structure may have the same height as the columns inward of the edges, but the top portion of the inward columns are embedded in a portion of the cap such that the upper surface of the cap on which the floor section rests is level with the top of the columns at the edges.

Each floor section 40 may also include steel reinforcement members 44 that extend through at least a portion of the floor section 40 and out of an upper surface of the floor section 40, as shown in FIG. 15. Horizontally adjacent floor sections 40 are coupled to each other. Various implementations for coupling the floor sections 40 to the caps 30' and each other and to the main body 50 are described below in relation to FIGS. 17-30. Once the main body 50 is cast over the floor sections 40 and steel reinforcement members 44, all of the components are locked together by the pouring and setting of the main body 50.

The details of example implementations of the connections between the pre-cast components are shown in FIGS. 17-30. Pre-cast and/or pre-stressed column caps 30' are erected on either pre-cast or cast in place concrete columns 20. The caps 30' are fastened to the column using vertical rods 35 (see, e.g., FIG. 23) that extend from the column 20, through the column cap 30', and into a form for pouring the main body 50 such that the vertical rods 35 extend into the main body 50. Once the column caps 30' are placed on the tops of the columns 20, washers and nuts are fastened to the end portions of the vertical rods 35 to form a temporary stability connection between the columns 20 and column caps 30' for the remaining erection of the structural pieces.

Pre-cast and/or pre-stressed floor sections 40 are erected on the previously placed column caps 30' (see, e.g., FIGS. 1-17, 18, 26 and 27). The perimeters 46 of floor sections 40 (or central opening in the floor section 40), the upper surface 33 of the support portion 32, and the surfaces of the alignment projection 34 of the cap 30 define a volume for receiving a first stage composite pour 48. The first stage composite pour 48 in one implementation comprises a cementitious material such as concrete or grout. In addition, an advancing bar connector and grouted joint 49 (see FIGS. 30B, 30C, and 30E) is established between the edges of adjacent floor sections 40, which allows for a mild flexural reinforcement across floor sections 40. The grouted joint 49 comprises a cementitious grout material, according to one implementation.

Figure 17:
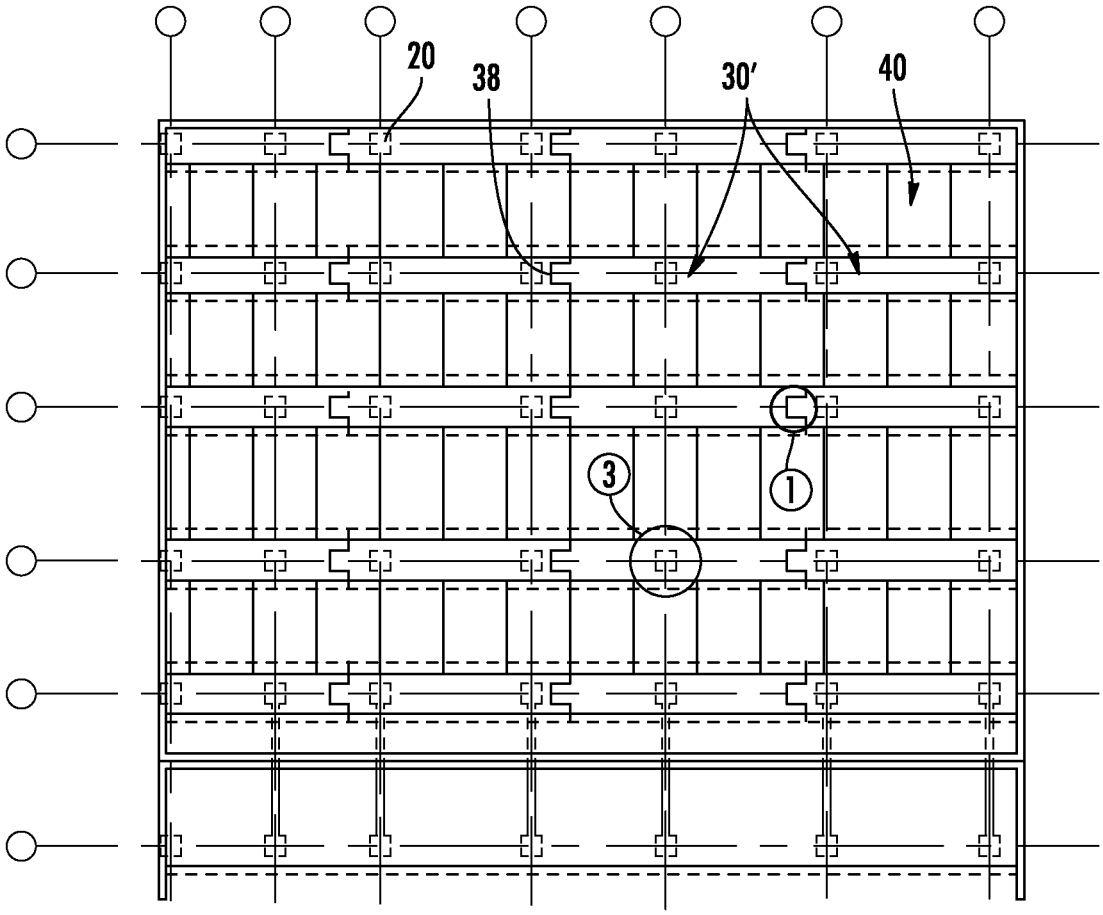
FIG. 17 illustrates a top view of the floor sections according to the implementation shown in FIGS. 3-8.
Figure 18:
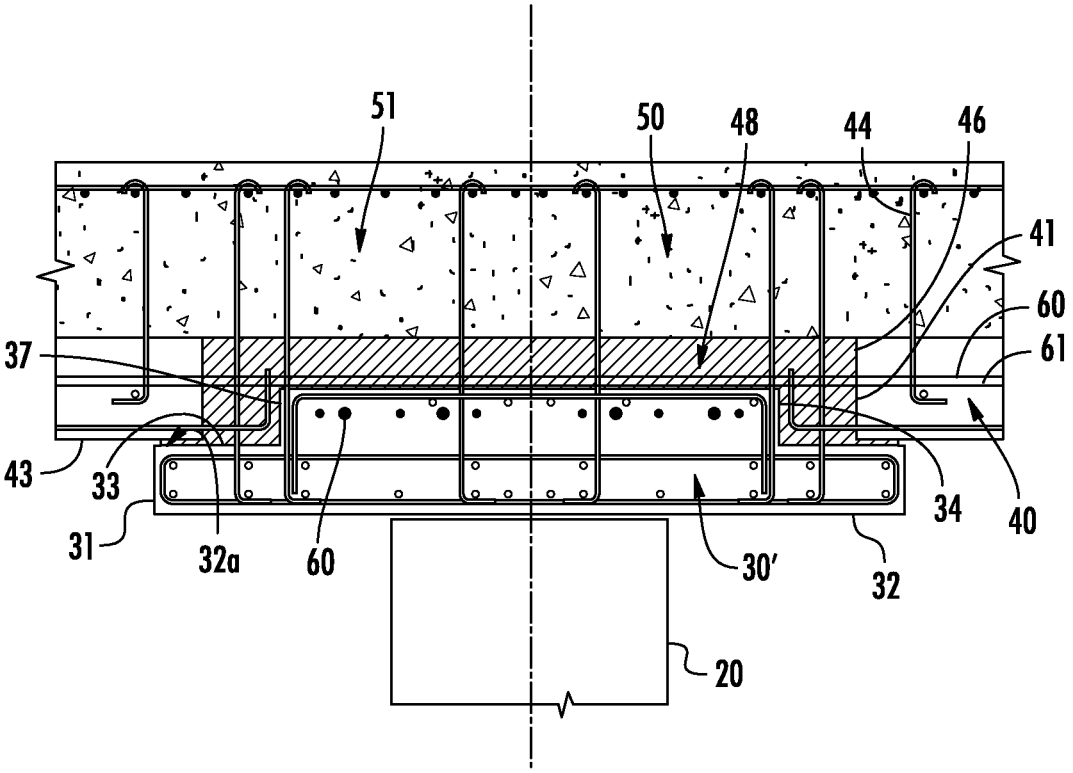
FIG. 18 illustrates a cross-sectional view of a portion of the concrete structure according to the implementation shown in FIG. 17 as viewed from the 1-1 line.
Figure 19:
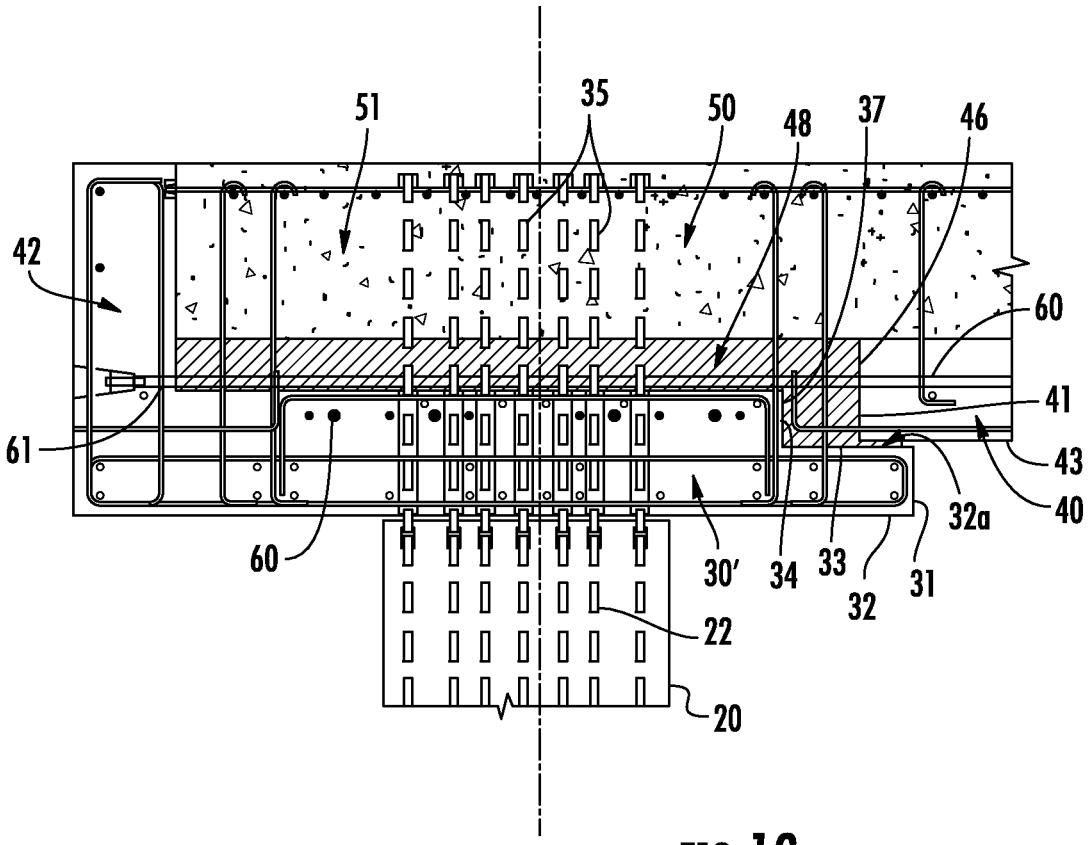
FIG. 19 illustrates a cross-sectional view of a portion of the concrete structure with vertical rods according to the implementation shown in FIG. 17 as viewed from the 2-2 line.
Figure 24:
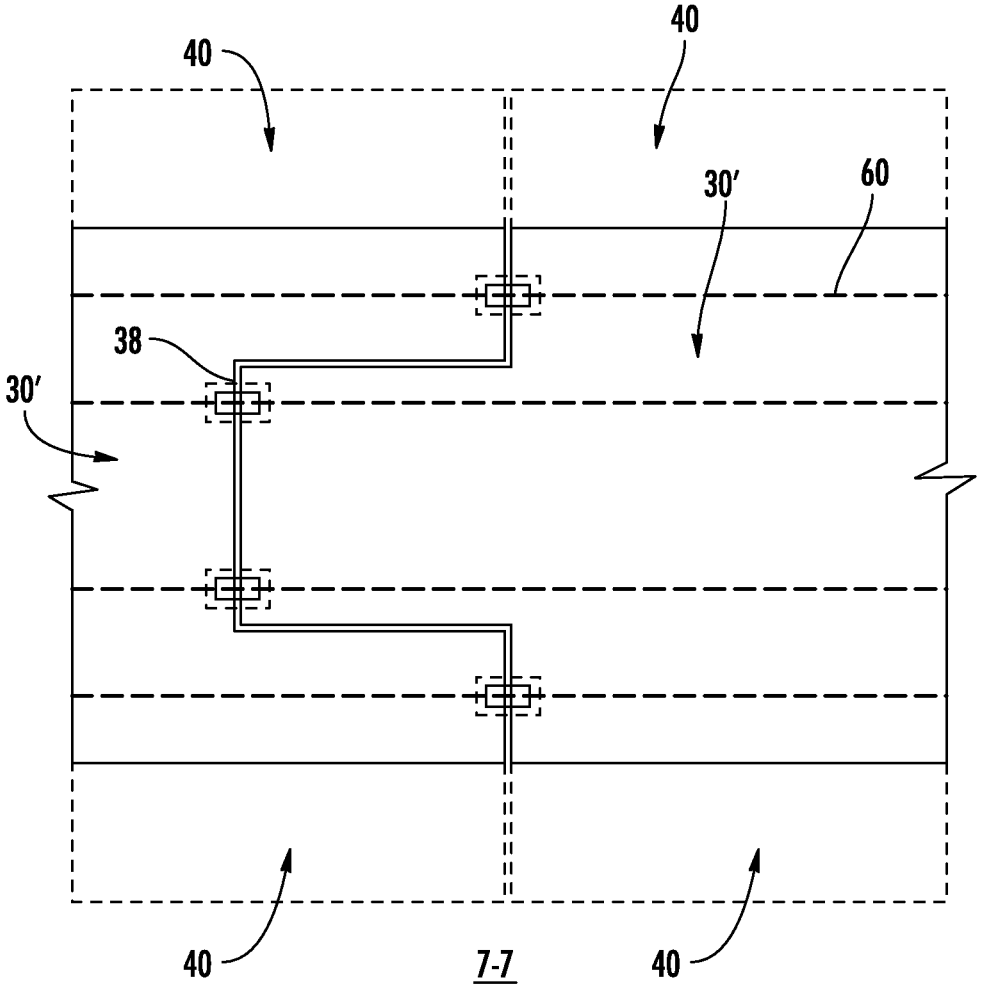
FIG. 24 illustrates a close-up view of a joint between two floor sections according to the implementation shown in FIG. 17 as viewed from detail view 7.
Figure 25:
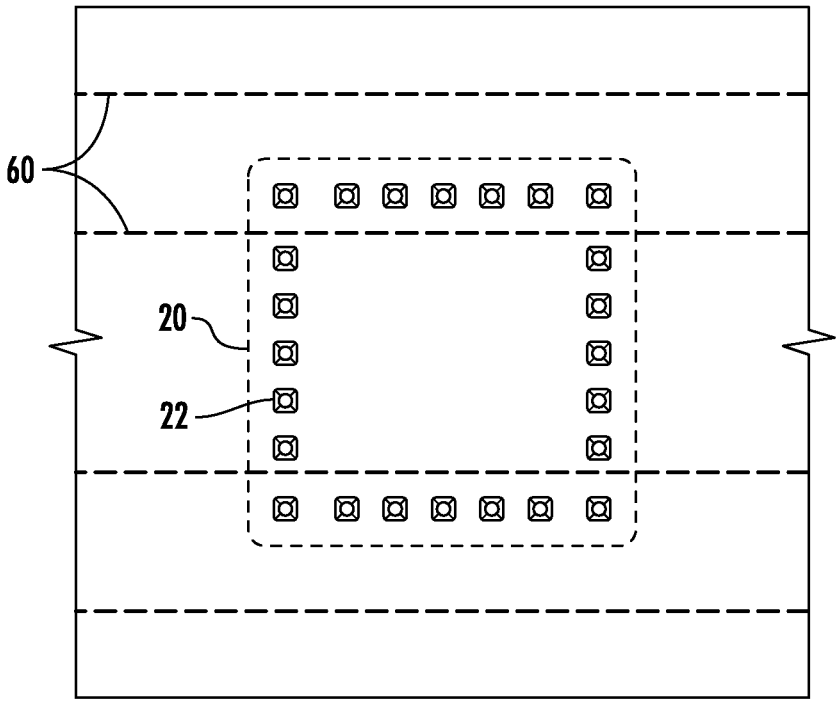
FIG. 25 illustrates a close-up view of a portion of the concrete structure with vertical rods according to the implementation shown in FIG. 17 as viewed from detail 8.
Figure 26:
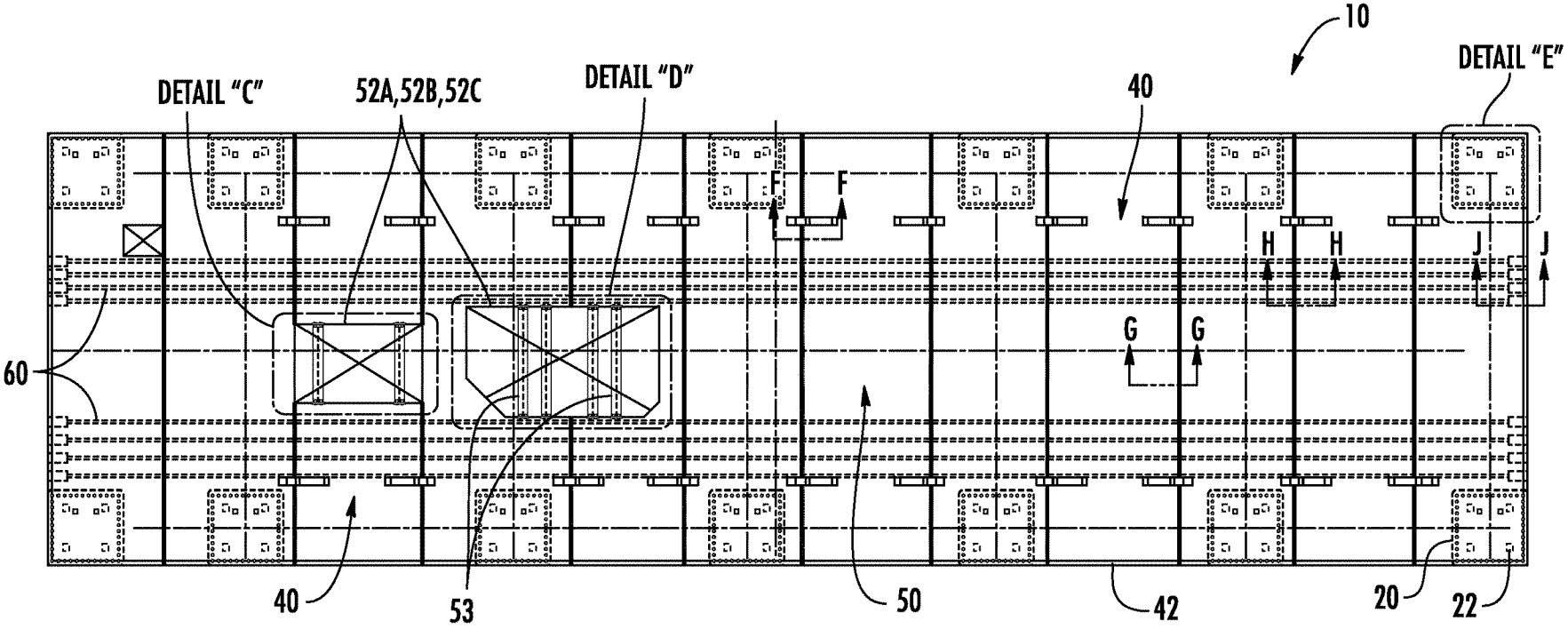
FIG. 26 illustrates a top view of a portion of the concrete structure according to the implementation shown in FIGS. 6-8.

In the implementation shown in FIGS. 1-9, column caps 30 are spaced apart from each other. However, in the implementation shown in FIG. 17, column caps 30' are elongated such that an edge of each column cap 30' abuts an edge of the horizontally adjacent column caps 30' in one direction, forming a continuous line of column caps 30'. FIGS. 17 and 24 show detailed views of the column cap 30' to column cap 30' finger joint 38 that transfers force between horizontally adjacent column caps 30'. Both shear and moment are transferred between the column caps 30' using grout only in the finger joint 38. No special connectors are required. As is described above in relation to FIGS. 1-16, portions of the lower surface 43 of the floor sections 40 that are adjacent the outer perimeter of the floor section 40 abut the upper surface 33 of the support members 32 of the column caps 30'.

Figure 11:
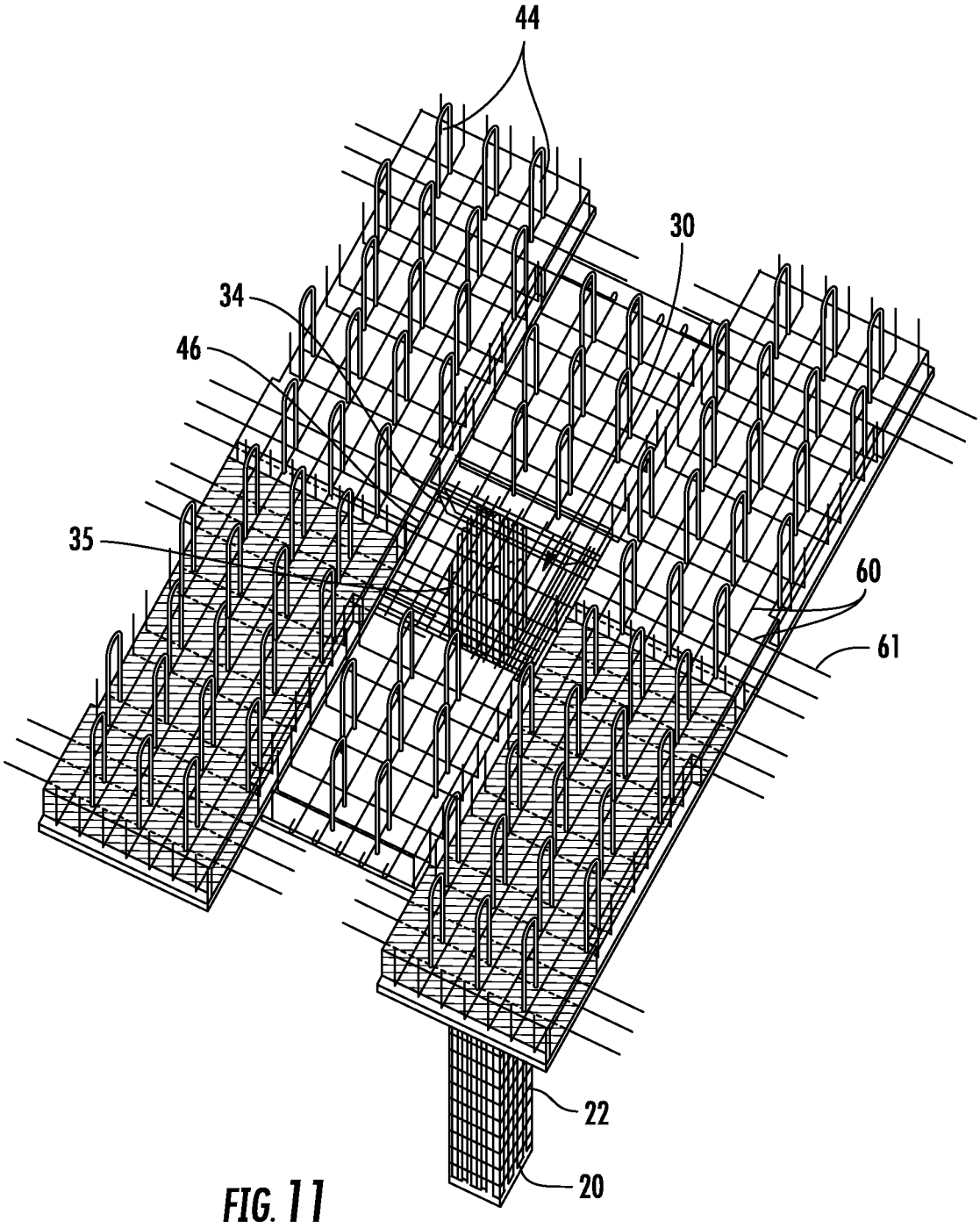
Figure 12:
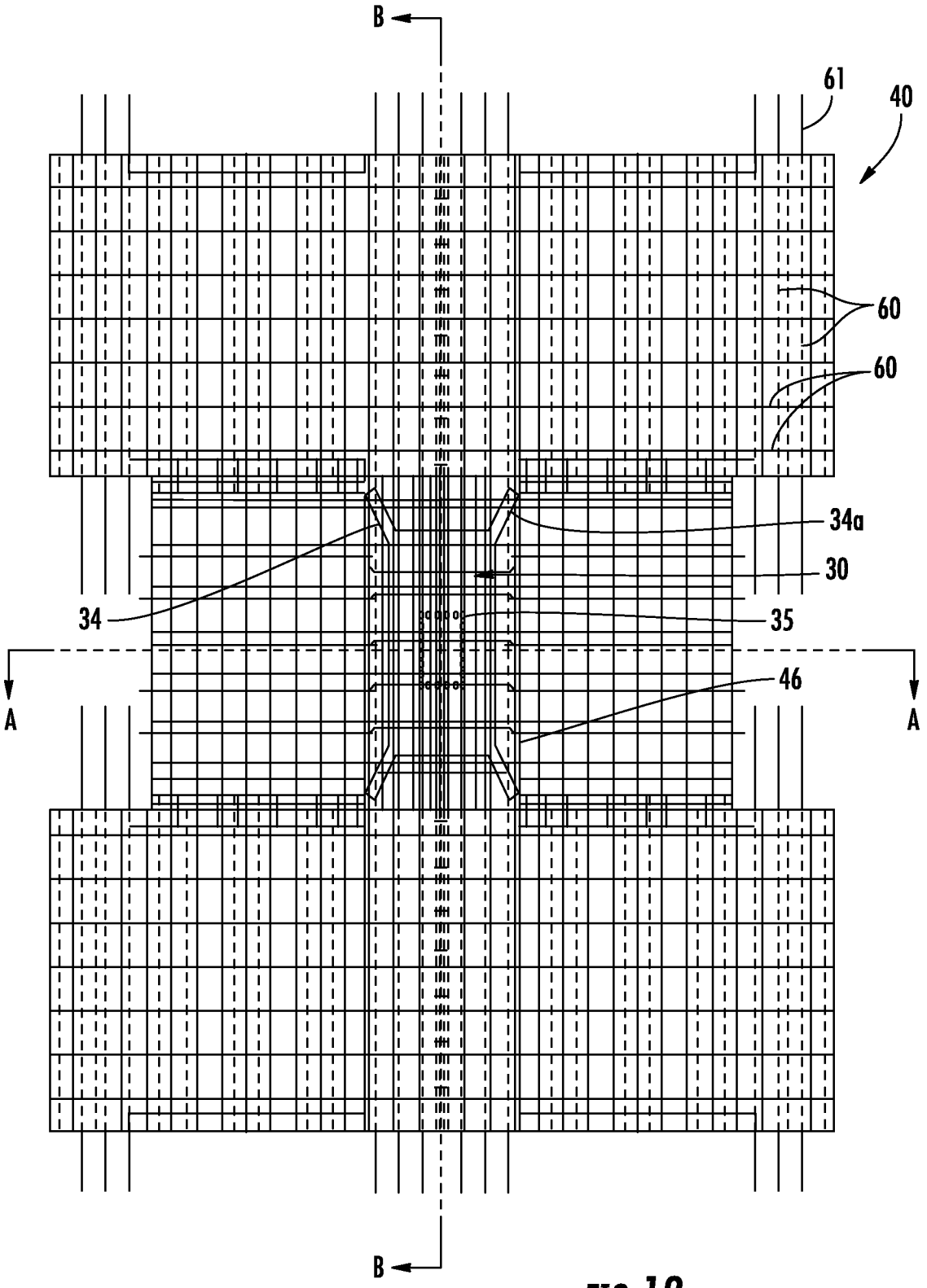
FIG. 12 illustrates a top view of the floor sections supported by the column cap according to the implementation shown in FIGS. 3-8.

Post-tensioning ducts 60 (see, e.g., FIGS. 18, 23, and 26) cast into the column caps 30' and the floor sections 40 form a two-directional grid of connected ducts 60 to receive post-tensioning tendons 61. As shown in FIG. 22, the ducts 60 in the column caps 30' and the ducts 60 in the floor sections 40 are arranged perpendicularly to each other as viewed from the upper surfaces of the floor section 40 and the cap 30', as shown in FIGS. 11 and 12. The post tensioning tendons 61 extend from a side section 42 on one side of the structure 10, through contiguously aligned post-tensioning ducts 60 in the floor sections 40 and column caps 30', to a side section 42 on an opposite side of the structure 10. After the first stage composite pour 48 (see, e.g., FIG. 18) and joint grouting 49 are completed, the two way grid of post-tensioning tendons 61 are stressed. The stressing of the tendons 61 places all joints between elements into a compressed condition. This state of biaxial compression overcomes any tendency for these joints to go into a tensile condition and favorable structural performance under static and vibratory loading.

To form the main body 50 of the platform, the first composite pour 48 is poured as described above and then a second stage composite pour 51 of concrete is poured onto the first composite pour 48 and the upper surface of the floor section 40 between side sections 42. As previously noted, this second stage concrete pour 51 covers the ends of rods 35 and steel reinforcement members 44, which are embedded in the main body 50 (see FIG. 23). Further, to define the apertures 52A, 52B, 52C through body 50 during the pour, a plug apparatus 53 (See FIGS. 29A-C) is disposed in the space where each aperture is to be defined during the pour and removed after the concrete is dry enough to hold its molded shape. The plug apparatus 53 includes at least one sidewall that forms the inner side(s) of each aperture. The at least one sidewall forms the shape of each aperture 52A, 52B, 52C, and the shape of the outer perimeter of the at least one sidewall is maintained by one or more pipes that extend between inner surfaces of opposite sides of the at least one sidewall. For example, the plug apparatuses shown in FIGS. 29A and 29B each have four side walls, and pipes 53*a* extend between two opposite sidewalls 53*b*, 53*c*. In other implementations, the plug apparatus may be a hollow cylinder having one sidewall, and one or more pipes extend between inner surfaces of the hollow cylinder. The plug apparatuses 53 act as braces within the apertures 52A, 52B, 52C to provide stability of the structure prior to and during erection and during the second stage composite concrete pour 51 of the main body 50. Other apparatuses for defining the apertures during pouring may also be used and are within the scope of the claims.

The compressors used to compress the natural gas cause a reciprocating load on the supporting structure, which requires a support with isotropic load-bearing properties. As pre-cast components typically are not isotropic, pre-cast components have not been used to support these types of compressors before. Typical pre-cast components can support four to five times the load in a primary direction as opposed to the load that can be borne in secondary directions. For example, pre-cast bridge components typically can support four to five times as much load in the traffic direction as compared to the transverse direction. In contrast, the disclosed composite structure can support approximately the same load in all directions. Because the gross cross-sectional properties in each orthogonal direction are the same and the general spacing of support columns are relatively the same, the structure disclosed herein allows for equal capacity in each direction (i.e. 2-way spanning slab). Thus, the composite structure provides relatively the same amount of reinforcement in both orthogonal directions. The combination of reinforced pre-cast components with a partial poured in place body creates a composite structure that has the isotropic properties to support the compressors and can be constructed using much less time and labor than conventional poured in place structures.

The present written description uses examples to disclose the present subject matter and to enable any person skilled in the art to practice the subject matter claimed, including making and using any devices or systems and performing any incorporated and/or associated methods. While the present subject matter has been described in detail with respect to specific implementations thereof, it will be appreciated that those skilled in the art, upon attaining an understanding of the foregoing may readily produce alterations to, variations of, and equivalents to such implementations. Accordingly, the scope of the present disclosure is by way of example rather than by way of limitation, and the subject disclosure does not preclude inclusion of such modifications, variations and/or additions to the present subject matter as would be readily apparent to one of ordinary skill in the art. For instance, features illustrated or described as part of one embodiment can be used with another embodiment to yield a still further embodiment. Thus, it is intended that the present subject matter covers such modifications and variations as come within the scope of the disclosure and equivalents thereof.

The invention claimed is:

1. A structure comprising:

a pre-cast concrete component including at least one horizontal duct;

a post-tensioning tendon extending through the duct, a portion of the post-tensioning tendon extending beyond a perimeter of the pre-cast component; and a poured in place concrete body disposed above and coupled to the pre-cast concrete component, wherein the poured in place concrete body comprises a first stage composite pour and a second stage composite pour, the first stage composite pour is directly coupled to at least a portion of the perimeter of the pre-cast component and surrounds the portion of the post-tensioning tendon extending beyond the perimeter of the pre-cast component, and the second stage composite pour is directly coupled to an upper surface of the first stage composite pour and an upper surface of the pre-cast component.

2. The structure according to claim 1, wherein the apparatus has isotropic load-bearing strengths.

3. The structure according to claim 1, wherein the pre-cast concrete component is a column.

4. The structure according to claim 1, wherein the pre-cast concrete component is a cap disposed on a top of a column.

5. The structure according to claim 1, wherein the pre-cast concrete component is a floor section that is coupled to a cap disposed on top of a column.

6. The structure according to claim 5, wherein the poured in place concrete body is directly coupled to the floor section by one or more reinforcement members that extend through at least a portion of the floor section and into the poured in place concrete body.

7. The structure according to claim 6, wherein the floor section has a perimeter, and the cap comprises a support member that includes an alignment projection that extends upwardly from a portion of an upper surface of the support member, the alignment projection having an outer perimeter and the upper surface of the support member having an outer perimeter, wherein the outer perimeter of the upper surface of the support member is spaced apart from the outer perimeter of the alignment projection, and a portion of a lower surface of the floor section adjacent the perimeter of the floor section abuts the upper surface of the support member of the cap such that the alignment projection of the cap extends upwardly along a portion of the perimeter of the floor section.

8. The structure according to claim 7, wherein the first stage composite pour is coupled to a portion of the perimeter of the floor section, the outer perimeter of the alignment projection, and a portion of the upper surface of the support member, and the second stage composite pour is coupled to the first stage composite pour and an upper surface of the floor section.

9. The structure according to claim 8, wherein the floor section comprises the plurality of reinforcement members extending from the upper surface of the floor section, and the plurality of reinforcement members are coupled to the second stage composite pour.

10. The structure according to claim 1, wherein the poured in place concrete body is directly coupled to the pre-cast component by one or more reinforcement members that extend through at least a portion of the pre-cast component and into the poured in place concrete body.

11. The structure according to claim 1, wherein the pre-cast concrete component is a floor section.

12. The structure according to claim 1, wherein the poured in place concrete body defines one or more apertures that extend through the concrete body.

13. A method for making a structure comprising:

providing a plurality of pre-cast concrete columns;

placing a pre-cast concrete floor section above two or more columns, at least one of the floor sections comprising a horizontal duct;

extending a post-tensioning tendon through the at least one duct, a portion of the post-tensioning tendon extending beyond a perimeter of the pre-cast component;

pouring a first stage composite pour, the first stage composite pour being directly coupled to at least a portion of a perimeter of the pre-cast concrete floor and surrounding the portion of the post-tensioning tendon extending beyond the perimeter of the pre-cast component;

tensioning the post-tensioning tendon; and pouring a second stage composite pour, the second stage composite pour being directly coupled to an upper surface of the first stage composite pour and an upper surface of the pre-cast concrete floor.

14. The method according to claim 13, wherein the poured in place concrete body defines a plurality of apertures that extend through the concrete body.

15. The method according to claim 13, further comprising placing a pre-cast concrete column cap on each of the columns between the floor section and the columns, wherein the post-tensioning tendon is a first post-tensioning tendon, and at least one column cap comprises a duct, and the method further comprises tensioning a second post-tensioning tendon running through the duct in the column cap.

16. The method according to claim 15, wherein the first post-tensioning tendon and the second post-tensioning tendon are arranged perpendicularly to each other as viewed from upper surfaces of the floor section and the column cap.

17. A structure comprising:

two or more pre-cast concrete columns;

a pre-cast concrete floor section that is disposed above the pre-cast concrete columns and spans between the columns, the pre-cast concrete floor section including at least one horizontal duct;

a post-tensioning tendon extending through the duct, a portion of the post-tensioning tendon extending beyond a perimeter of the pre-cast concrete floor section; and a poured in place concrete body disposed above and coupled to the pre-cast concrete floor section, wherein the poured in place concrete body comprises a first stage composite pour and a second stage composite pour, the first stage composite pour is directly coupled to at least a portion of the perimeter of the pre-cast concrete floor section and surrounds the portion of the post-tensioning tendon extending beyond the perimeter of the pre-cast concrete floor section, and the second stage composite pour is directly coupled to an upper surface of the first stage composite pour and an upper surface of the pre-cast concrete floor section.

18. The structure according to claim 17, wherein the poured in place concrete body defines one or more apertures that extend through the concrete body.

19. The structure according to claim 17, further comprising a pre-cast concrete cap disposed on a top surface of the column, the floor section is disposed on the cap, and the poured in place concrete body is disposed on the floor section.

* * * * *